US010746455B2

(12) United States Patent
Kim

(10) Patent No.: US 10,746,455 B2
(45) Date of Patent: Aug. 18, 2020

(54) REFRIGERATOR

(71) Applicant: LG ELECTRONICS INC., Seoul (KR)

(72) Inventor: Hosan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1009 days.

(21) Appl. No.: 15/172,339

(22) Filed: Jun. 3, 2016

(65) Prior Publication Data

US 2017/0030627 A1 Feb. 2, 2017

(30) Foreign Application Priority Data

Jul. 28, 2015 (KR) ..... 10-2015-0106881

(51) Int. Cl.
*F25D 11/02* (2006.01)
*F25B 47/02* (2006.01)
(Continued)

(52) U.S. Cl.
CPC ..... *F25D 11/022* (2013.01); *F25B 41/04* (2013.01); *F25B 41/067* (2013.01);
(Continued)

(58) Field of Classification Search
CPC ..... F25D 11/022; F25D 21/12; F25D 17/067; F25D 21/125; F25D 17/065; F25B 41/04;
(Continued)

(56) References Cited

U.S. PATENT DOCUMENTS 4,648,247 A * 3/1987 Takizawa ..... A47F 3/0447 62/256
6,318,107 B1 11/2001 Pandaru et al.
(Continued)

FOREIGN PATENT DOCUMENTS

CN 201034399 3/2008
CN 104613696 5/2015
(Continued)

OTHER PUBLICATIONS

Chinese Office Action in Chinese Application No. 201610596626.2, dated Jun. 22, 2018, 16 pages.
(Continued)

*Primary Examiner* — Frantz F Jules
*Assistant Examiner* — Martha Tadesse
(74) *Attorney, Agent, or Firm* — Fish & Richardson P.C.

(57) ABSTRACT

A refrigerator includes a compressor that is configured to compress a refrigerant, a condenser that is configured to condense the refrigerant compressed in the compressor, an expander that is configured to depressurize the refrigerant condensed in the condenser, a first evaporator provided at one side of a refrigerator compartment, and that is configured to evaporate the refrigerant depressurized in the expander, a second evaporator provided at one side of a freezer compartment, and that is configured to evaporate the refrigerant depressurized in the expander, a valve unit provided at an outlet pipe of the condenser, and that is configured to introduce the refrigerant into at least one of the first or second evaporators, and a hot gas path that connects the valve unit to the second evaporator, and that is configured to guide flow of the refrigerant that has passed through the condenser.

12 Claims, 20 Drawing Sheets

(51) Int. Cl.

| | |
|---|---|
| ***F25B 41/04*** | (2006.01) |
| ***F25D 21/12*** | (2006.01) |
| ***F25B 41/06*** | (2006.01) |
| *F25D 17/06* | (2006.01) |

(52) U.S. Cl.
CPC ..... *F25B 47/022* (2013.01); *F25D 21/12* (2013.01); *F25B 2600/2501* (2013.01); *F25D 17/067* (2013.01); *F25D 21/125* (2013.01)

(58) Field of Classification Search
CPC ..... F25B 47/022; F25B 41/067; F25B 2600/2501; F25B 2600/25; F25B 2313/02522
See application file for complete search history.

(56) References Cited

U.S. PATENT DOCUMENTS

| | | | | |
|---|---|---|---|---|
| 9,651,285 | B2 * | 5/2017 | Kim | F25B 1/10 |
| 2009/0188270 | A1 * | 7/2009 | Takahashi | F25B 9/006 62/272 |
| 2010/0287961 | A1 * | 11/2010 | Song | F25B 5/04 62/81 |
| 2012/0023978 | A1 * | 2/2012 | Chae | F25B 1/10 62/115 |
| 2012/0023981 | A1 * | 2/2012 | Chae | F25B 5/02 62/115 |
| 2013/0340454 | A1 * | 12/2013 | Kim | F25B 1/10 62/126 |
| 2014/0053581 | A1 * | 2/2014 | Cho | F25D 21/008 62/80 |

FOREIGN PATENT DOCUMENTS

| | | | | |
|---|---|---|---|---|
| CN | 104613699 | | 5/2015 | |
| CN | 104748420 | | 7/2015 | |
| DE | 3012541 | | 10/1981 | |
| DE | 3012541 | A1 * | 10/1981 | F25B 30/02 |
| JP | 2005274057 | | 10/2005 | |
| KR | 20130081382 | | 7/2013 | |
| KR | 20140113077 | A * | 9/2014 | |
| KR | 101450805 | B1 * | 10/2014 | |
| WO | WO0186215 | | 11/2011 | |

OTHER PUBLICATIONS

European Communication pursuant to Article 94(3) EPC in European Application No. 16179211.4, dated Oct. 24, 2017, 6 pages (with English translation).
Extended European Search Report in European Application No. 16179211.4-1605, dated Dec. 21, 2016, 8 pages (with English translation).

* cited by examiner

REFRIGERATOR

CROSS-REFERENCE TO RELATED APPLICATION(S)

This application claims priority under 35 U.S.C. § 119 and 35 U.S.C. § 365 to Korean Patent Application No. 10-2015-0106881, filed in Korea on Jul. 28, 2015, whose entire disclosure is hereby incorporated by reference.

BACKGROUND

Generally, a refrigerator has a plurality of storage compartments which accommodate stored goods and keep food refrigerated or frozen, and one surface of each of the storage compartments is formed to be opened to allow for a user to access the storage compartment. The plurality of storage compartments may include a freezer compartment in which the food is kept frozen, and a refrigerator compartment in which the food is kept refrigerated.

SUMMARY

According to one aspect, a refrigerator may include a compressor that is configured to compress a refrigerant, a condenser that is configured to condense the refrigerant compressed in the compressor, an expander that is configured to depressurize the refrigerant condensed in the condenser, a first evaporator provided at one side of a refrigerator compartment, and that is configured to evaporate the refrigerant depressurized in the expander, a second evaporator provided at one side of a freezer compartment, and that is configured to evaporate the refrigerant depressurized in the expander, a valve unit provided at an outlet pipe of the condenser, and that is configured to introduce the refrigerant into at least one of the first or second evaporators, and a hot gas path that connects the valve unit to the second evaporator, and that is configured to guide flow of the refrigerant that has passed through the condenser.

Implementations according to this aspect may include one or more of the following features. For example, the refrigerator may include a first refrigerant path in which the first evaporator is installed, a second refrigerant path in which the second evaporator is installed, where the first and second refrigerant paths are branched, and are configured to extend from the valve unit. The valve unit may include a four-way valve. The valve unit may include an inlet part that is configured to introduce the refrigerant passed through the condenser, a first outlet part that is configured to connect to the first refrigerant path, a second outlet part that is configured to connect to the second refrigerant path, and a third outlet part that is configured to connect to the hot gas path. The first refrigerant path may include a combination part that is configured to connect to the hot gas path. The expander may include a first expander that is installed at the first refrigerant path, and a second expander that is installed at the second refrigerant path. In a first operation mode, the valve unit may be configured to operate when at least one outlet part of the first or second outlet parts is opened, and the third outlet part is closed. In an operation mode for cooling the freezer compartment of the first operation mode, the valve unit may be configured to operate based on the second outlet part being opened and the first outlet part being closed.

The valve unit may be configured to operate based on the first and second outlet parts being opened in an operation mode for simultaneous cooling of the first operation mode.

The valve unit may be configured to operate in a second operation mode based on the first and second outlet parts being closed and the third outlet part being opened. The compressor may include a first compressor that is disposed at a low pressure side, and a second compressor that is installed at an outlet part of the first compressor, and that is disposed at a high pressure side, and the refrigerant that passes through the second evaporator is single-stage compressed in the first compressor, the single-stage compressed refrigerant is combined with the refrigerant that passed through the first evaporator, and is introduced into the second compressor. The refrigerator may include a first evaporator fan that is provided at one side of the first evaporator, and that may be configured to blow cooling air in the refrigerator compartment to the first evaporator side for a defrosting of the first evaporator. Based on an operation mode for defrosting the first evaporator being performed, the valve unit may be configured such that refrigerant flows to the second evaporator side, a flow to the first evaporator and the hot gas path being restricted, and the first evaporator fan is configured to operate. The second evaporator may include a first pipe in which the refrigerant depressurized in the expander is configured to flow and a second pipe in which the refrigerant of the hot gas path is configured to flow.

According to another aspect, a refrigerator may include a compressor that is configured to compress a refrigerant, a condenser that is configured to condense the refrigerant compressed in the compressor, a four-way valve installed to an outlet pipe of the condenser, a first refrigerant path that is configured to extend from a first outlet part of the four-way valve, and to which a first expander is installed, a second refrigerant path that is configured to extend from a second outlet part of the four-way valve, and to which a second expander is installed, an evaporator of a refrigerator compartment that is installed at an outlet part of the first expander, an evaporator of a freezer compartment that is installed at an outlet part of the second expander, and a hot gas path that is configured to extend from the four-way valve to the second evaporator.

Implementations according to this aspect may include one or more of the following features. For example, the four-way valve may include a third outlet part that is configured to connect to the hot gas path, and the hot gas path may be configured to pass through the evaporator of the freezer compartment from the third outlet part, and that is configured to connect to the first refrigerant path. The valve unit may be configured such that at least one outlet part of the first and second outlet parts is opened, and the third outlet part is closed in a first operation mode, and the first and second outlet parts are closed and the third outlet part is opened when in a second operation mode. The compressor may include a first compressor that is configured to compress a refrigerant that has passed through the second evaporator, a second compressor that is configured to compress a refrigerant that has passed through the first evaporator is compressed, and the refrigerant that is compressed in the first compressor is combined with the refrigerant that has passed through the first evaporator and is introduced into the second compressor. At least one of the first and second expanders may include a capillary tube.

DETAILED DESCRIPTION

Figure 1:
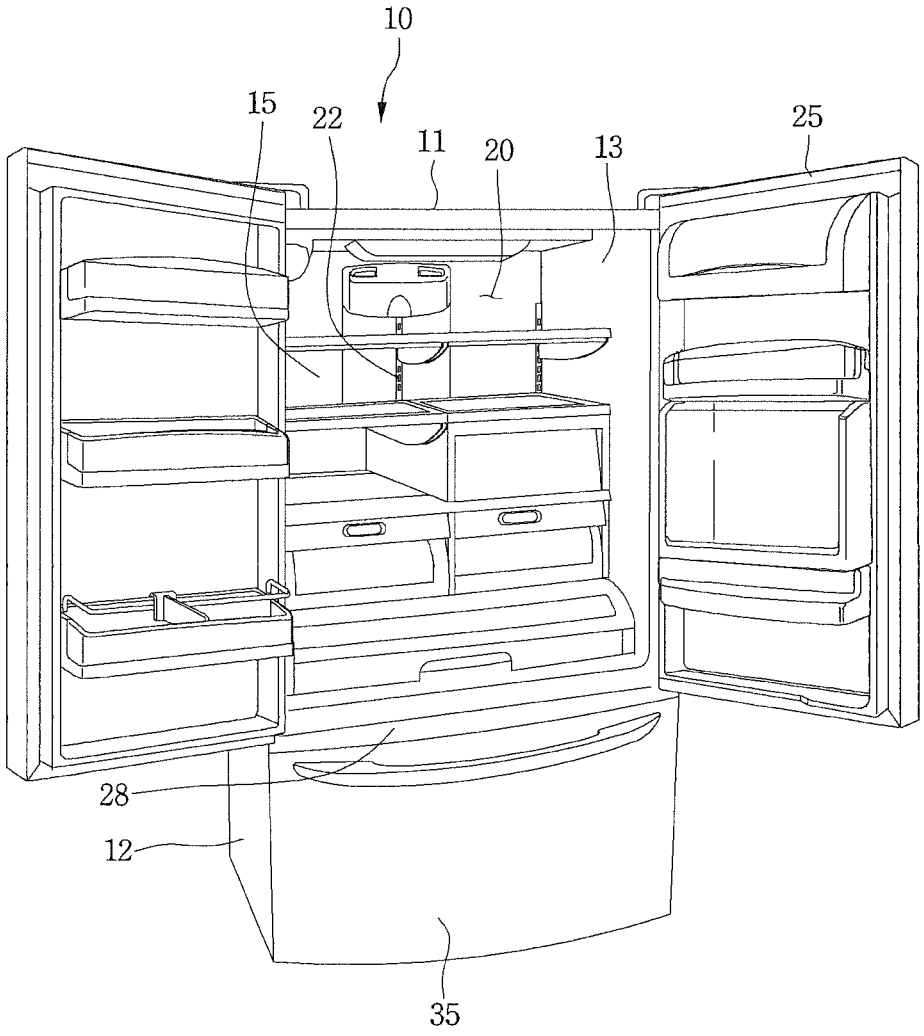
FIG. 1 is a perspective view illustrating an example of a refrigerator.

Referring to FIGS. 1 to 4, a refrigerator 10 includes a cabinet 11 which forms a storage compartment. The storage compartment includes a refrigerator compartment 20 and a freezer compartment 30. For example, the refrigerator compartment 20 may be disposed at an upper side of the freezer compartment 30. However, positions of the refrigerator compartment 20 and the freezer compartment 30 are not limited to this configuration. The refrigerator compartment 20 and the freezer compartment 30 may be divided by a partition wall 28.

The refrigerator 10 includes a refrigerator compartment door 25 which is configured to open and close the refrigerator compartment 20 and a freezer compartment door 35 which is configured to open and close the freezer compartment 30. The refrigerator compartment door 25 may be hinge-coupled to a front of the cabinet 11 and may be formed to be rotatable, and the freezer compartment door 35 may be formed in a drawer type to be withdrawn forward.

Based on the cabinet 11 of FIG. 1, a direction at which the refrigerator compartment door 25 is located is defined as a "front side", and an opposite direction thereof is defined as a "rear side", and a direction toward a side surface of the cabinet 11 is defined as a "lateral side".

The cabinet 11 may include an outer case 12 which forms an exterior of the refrigerator 10, and an inner case 13 which is disposed inside the outer case 12 and forms at least a part of an inner surface of the refrigerator compartment 20 or the freezer compartment 30. The inner case 13 includes a refrigerator compartment side inner case which forms the inner surface of the refrigerator compartment 20, and a freezer compartment side inner case which forms the inner surface of the freezer compartment 30.

A panel 15 is provided at a rear surface of the refrigerator compartment 20. The panel 15 may be installed at a position which is spaced forward from a rear of the refrigerator compartment side inner case. A refrigerator compartment cooling air discharge part 22 for discharging cooling air to the refrigerator compartment 20 is provided at the panel 15. For example, the refrigerator compartment cooling air discharge part 22 may be formed of a duct, and may be disposed to be coupled to an approximately central portion of the panel 15.

A freezer compartment side panel may be installed at a rear wall of the freezer compartment 30, and a freezer compartment cooling air discharge part for discharging the cooling air to the freezer compartment 30 may be formed at the freezer compartment side panel.

An installation space in which a first evaporator 110 is installed is formed at a space between the panel 15 and a rear of the inner case 13. An installation space in which a second evaporator 150 is installed may be formed at a space between the panel and a rear of the freezer compartment side inner case.

The refrigerator 10 includes a plurality of evaporators 110 and 150 which cool the refrigerator compartment 20 and the freezer compartment 30, respectively. The plurality of evaporators 110 and 150 include the first evaporator 110 which cools the refrigerator compartment 20, and the second evaporator 150 which cools the freezer compartment 30. The first evaporator 110 may be referred to as a "refrigerator compartment evaporator", and the second evaporator 150 may be referred to as a "freezer compartment evaporator".

Figure 2:
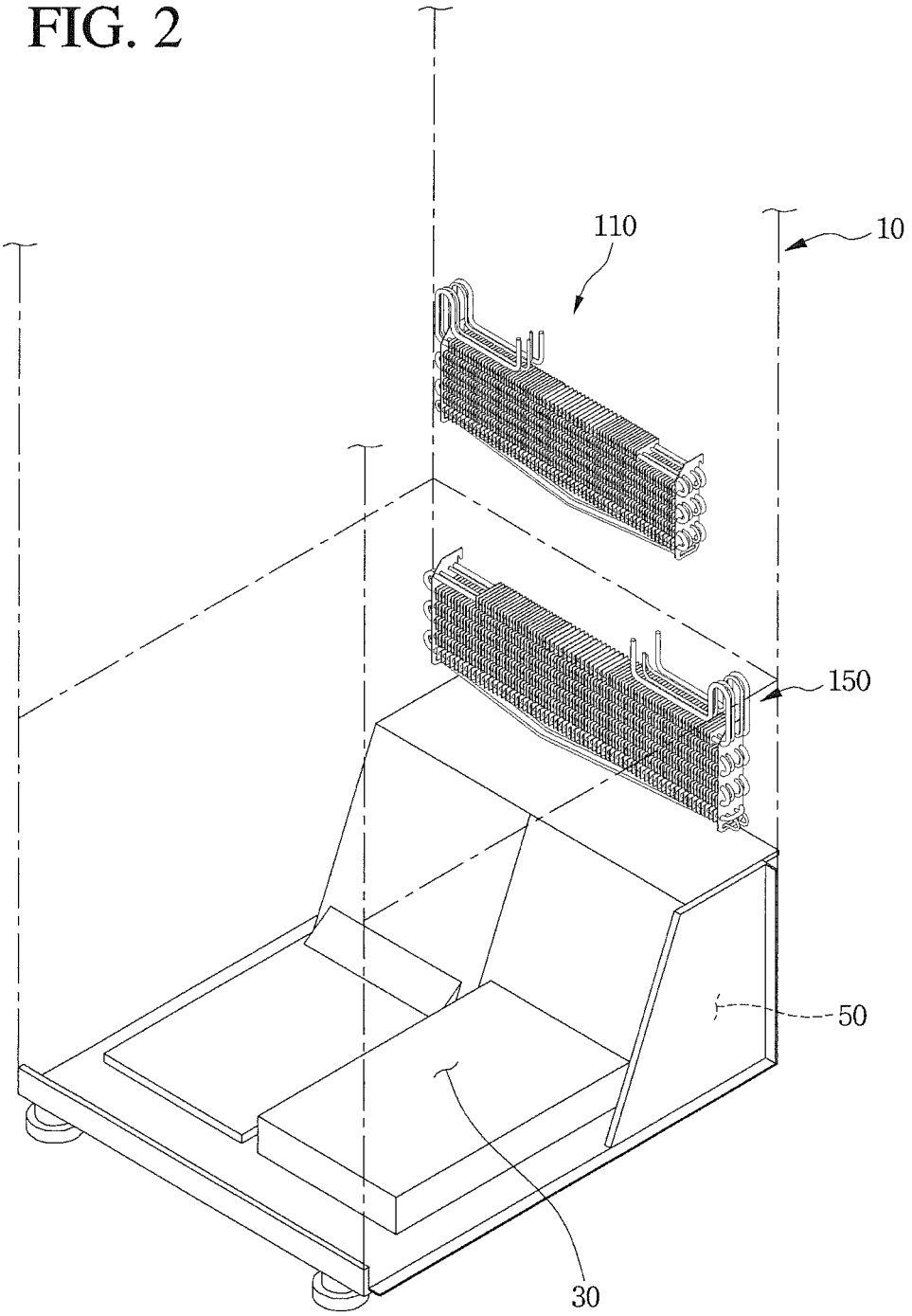
FIG. 2 is a view of a partial configuration of the refrigerator.
Figure 3:
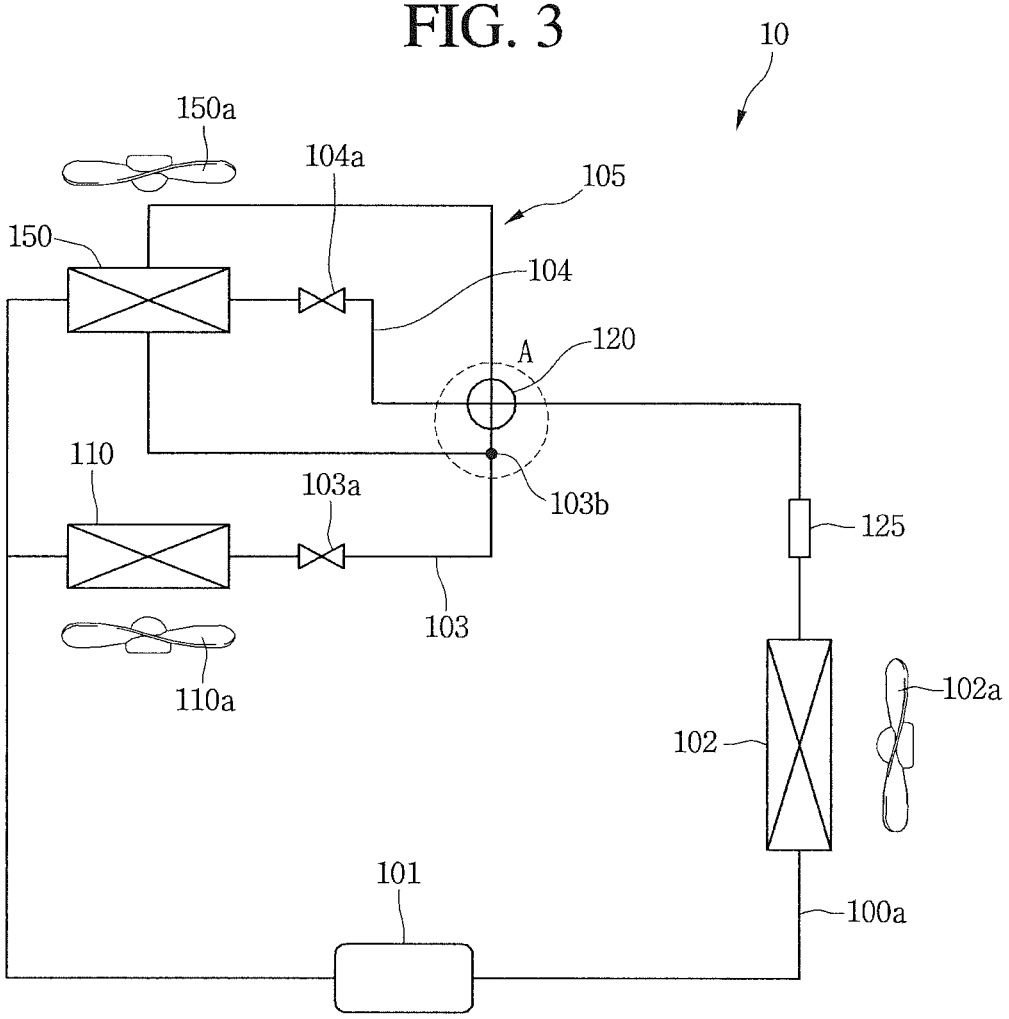
FIG. 3 illustrates an example of a cycle of the refrigerator.
Figure 4:
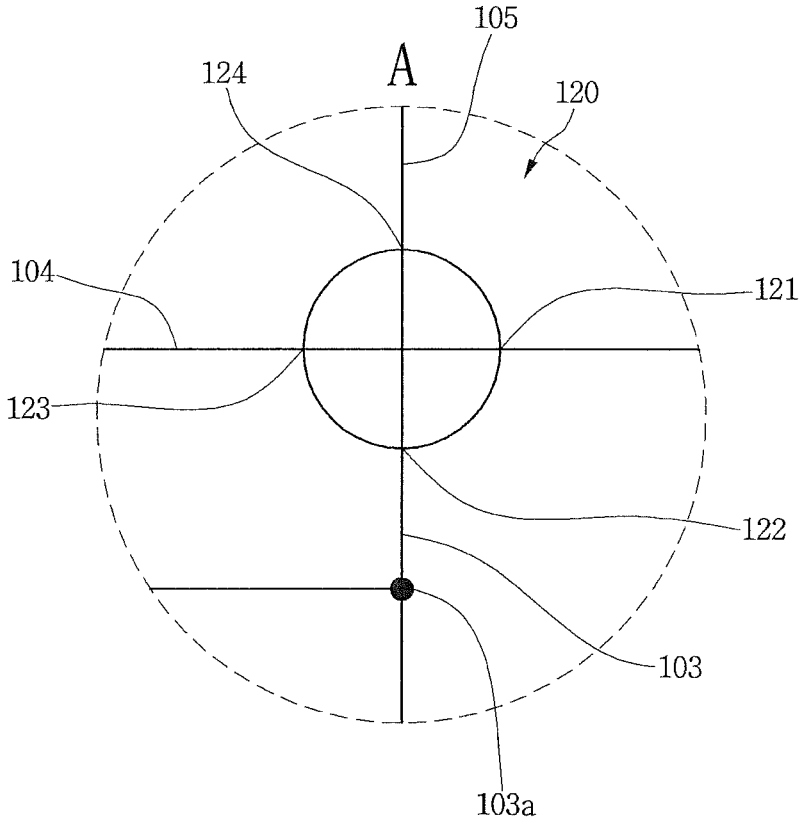
FIG. 4 is an enlarged view of an A portion of FIG. 3.

The refrigerator compartment 20 is disposed at an upper side of the freezer compartment 30, and as illustrated in FIG. 2, the first evaporator 110 may be disposed at an upper side of the second evaporator 150.

The first evaporator 110 may be disposed at a rear wall of the refrigerator compartment 20, i.e., a rear side of the panel 15, and the second evaporator 150 may be disposed at a rear wall of the freezer compartment 30, i.e., a rear side of the freezer compartment side panel. The cooling air generated at the first evaporator 110 may be supplied to the refrigerator compartment 20 through the refrigerator compartment cooling air discharge part 22, and the cooling air generated at the second evaporator 150 may be supplied to the freezer compartment 30 through the freezer compartment cooling air discharge part.

The first evaporator 110 and the second evaporator 150 may be hooked to the inner case 13. For example, the second evaporator 150 includes hooks 162 and 167 (referring to FIG. 9) which are hooked to the inner case 13.

The refrigerator 10 includes a plurality of devices for driving a refrigeration cycle. Specifically, the refrigerator 10 includes a compressor 101 which compresses a refrigerant, a condenser 102 which condenses the refrigerant compressed in the compressor 101, a plurality of expanders 103*a* and 104*a* which depressurize the refrigerant condensed in the condenser 102, and the plurality of evaporators 110 and 150 which evaporate the refrigerant depressurized in the plurality of expanders 103*a* and 104*a*.

The refrigerator 10 further includes a refrigerant pipe 100*a* which connects the compressor 101, the condenser 102, the expanders 103*a* and 104*a* and the evaporators 110 and 150 and guides a flow of the refrigerant.

The plurality of evaporators 110 and 150 include the first evaporator 110 for generating the cooling air which will be supplied to the refrigerator compartment 20, and the second evaporator 150 for generating the cooling air which will be supplied to the freezer compartment 30. The first evaporator 110 may be disposed at one side of the refrigerator compartment 20, and the second evaporator 150 may be disposed at one side of the freezer compartment 30. And the first and second evaporators 110 and 150 may be connected in parallel with each other.

A temperature of the cooling air supplied to the freezer compartment 30 may be lower than that of the cooling air supplied to the refrigerator compartment 20, and thus a refrigerant evaporation pressure of the second evaporator 150 may be lower than that of the first evaporator 110. The refrigerant evaporated in the first evaporator 110 and the second evaporator 150 may be combined, and then may be suctioned into the compressor 101.

The plurality of expanders 103*a* and 104*a* include a first expander 103*a* for expanding the refrigerant which will be introduced into the first evaporator 110, and a second expander 104*a* for expanding the refrigerant which will be introduced into the second evaporator 150. Each of the first and second expanders 103*a* and 104*a* may include a capillary tube.

In order for the refrigerant evaporation pressure of the second evaporator 150 to be formed lower than that of the first evaporator 110, a diameter of the capillary tube of the second expander 104*a* may be smaller than that of the capillary tube of the first expander 103*a*.

The refrigerator 10 includes a first refrigerant path 103 and a second refrigerant path 104 which are branched from the refrigerant pipe 100*a*. The first refrigerant path 103 is connected to the first evaporator 110, and the second refrigerant path 104 is connected to the second evaporator 150.

The first expander 103*a* is installed at the first refrigerant path 103, and the second expander 104*a* is installed at the second refrigerant path 104.

The refrigerator 10 further includes a valve unit 120 which is installed at an outlet pipe of the condenser 102 to branch and introduce a refrigerant to the refrigerant path 103 and 104. The valve unit 120 can control the flow of the refrigerant so that the first and second evaporators 110 and 150 may perform a simultaneous operation or single operation, that is, the refrigerant can be introduced to at least one of the evaporators 110 and 150, in a first operation mode of the refrigerator.

The refrigerator 10 further includes a hot gas path 105 which guides to supply the hot temperature refrigerant passed through the condenser 102 to the second evaporator 150 so that a defrosting of the second evaporator 150 can be performed. The hot gas path 105 may be configured to be extended to the side of the second evaporator 150, combined with the second evaporator 150, and connected to the first refrigerant path 103 via the second evaporator 150.

The first refrigerant path 103 includes a combination part 103*b* to which the hot gas path 105 is connected. That is, a one end part of the hot gas path 105 may be connected to a third outlet part 124 and the other end part may be connected to the combination part 103*b* of the first refrigerant path 103.

The valve unit 120 includes an inlet part 121 into which a refrigerant is introduced, and a four-way valve with three outlet parts 122, 123, and 124 from which the refrigerant is discharged. The inlet part 121 guides the refrigerant passed through the condenser 102 to be introduced to the valve unit 120. The three outlet parts 122, 123, and 124 include a first outlet part 122 which guides the refrigerant introduced into the valve unit 120 through the inlet part 121, to be discharged to the first refrigerant path 103. That is, the first outlet part 122 may be connected to the first refrigerant path 103.

The three outlet parts 122, 123, and 124 further include a second outlet part 123 which guides the refrigerant introduced into the valve unit 120 to be discharge to the second refrigerant path 104. That is, the second outlet part 123 may be connected to the second refrigerant path 104. The three outlet parts 122, 123, and 124 further include the third outlet part 124 which guides the refrigerant introduced into the valve unit 120 to be discharged to the hot gas path 105. That is, the third outlet part 124 may be connected to the hot gas path 105.

The refrigerant introduced into the inlet part 121 of the valve unit 120 may be discharged to at least one outlet part of the first outlet part 122 and the second outlet part 123 in the first operation mode of the refrigerator. When the first operation mode of the refrigerator is performed, the valve unit 120 may be controlled to close the third outlet part 124.

For example, when the first operation mode of the refrigerator performs a simultaneous cooling mode, the refrigerant may be branched and discharged to the first outlet part 122 and the second outlet part 123, and each flows in the first refrigerant path 103 and the second refrigerant path 104 and may be introduced into the first and second evaporators 110 and 150.

As another example, when the first operation mode of the refrigerator performs a cooling mode of the refrigerator compartment, the refrigerant may be discharged through the first outlet part 122, flow in the first refrigerant path 103, and be introduced into the first evaporator 110. At this time, the second outlet part 123 is closed and the flow of the refrigerant through the second refrigerant path 104 is restricted.

In another example, when the first operation mode of the refrigerator performs a cooling mode of the freezer compartment, the refrigerant may be discharged through the second outlet part 123, flow in the second refrigerant path 104, and be introduced into the second evaporator 150. At this time, the first outlet part 122 is closed and the flow of the refrigerant through the first refrigerant path 103 is restricted.

The refrigerator 10 may include a drier 125 which is installed at the outlet part of the condenser 102 and can filter moisture or foreign materials in the refrigerant. The drier 125 may be installed at the pipe connected between the condenser 102 and the valve unit 120.

The refrigerator 10 further includes fans 102*a*, 110*a*, and 150*a* which are installed at one side of a heat exchanger and blow air. The fans 102*a*, 110*a*, and 150*a* include a condenser fan 102*a* installed at one side of the condenser 102, a first evaporator fan 110*a* which is provided at one side of the first evaporator 110, and a second evaporator fan 150*a* which is provided at one side of the second evaporator 150.

According to the rotating speed of the evaporator fans 110*a* and 150*a*, the heat exchange capability of the first and second evaporators 110 and 150 may be changed. For example, when cooling air is required by operating the first evaporator 110, the rotating speed of the first evaporator fan 110*a* is increased. When the cooling air is enough, the rotating speed of the first evaporator fan 110*a* may be decreased.

Figure 5:
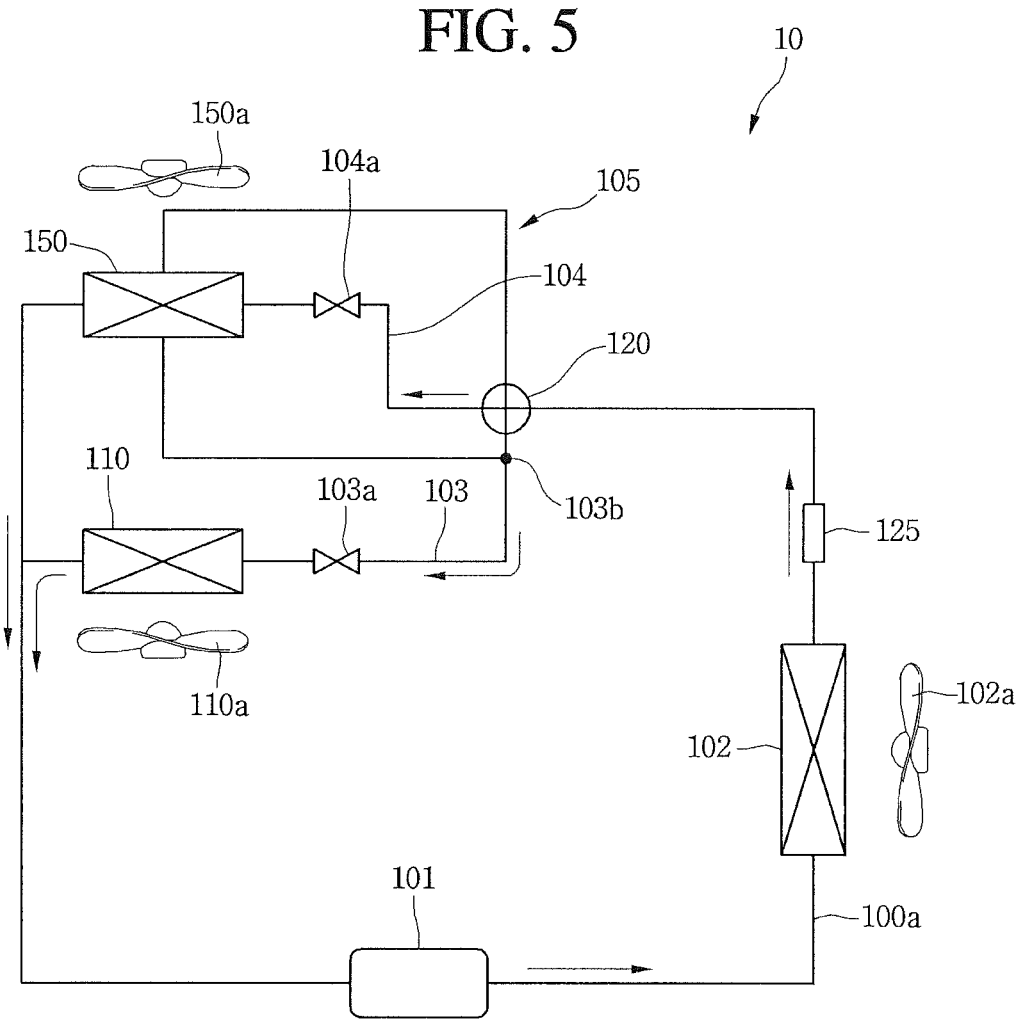
FIG. 5 illustrates an example flow of a refrigerant when the refrigerator performs a first operation mode.
Figure 6:
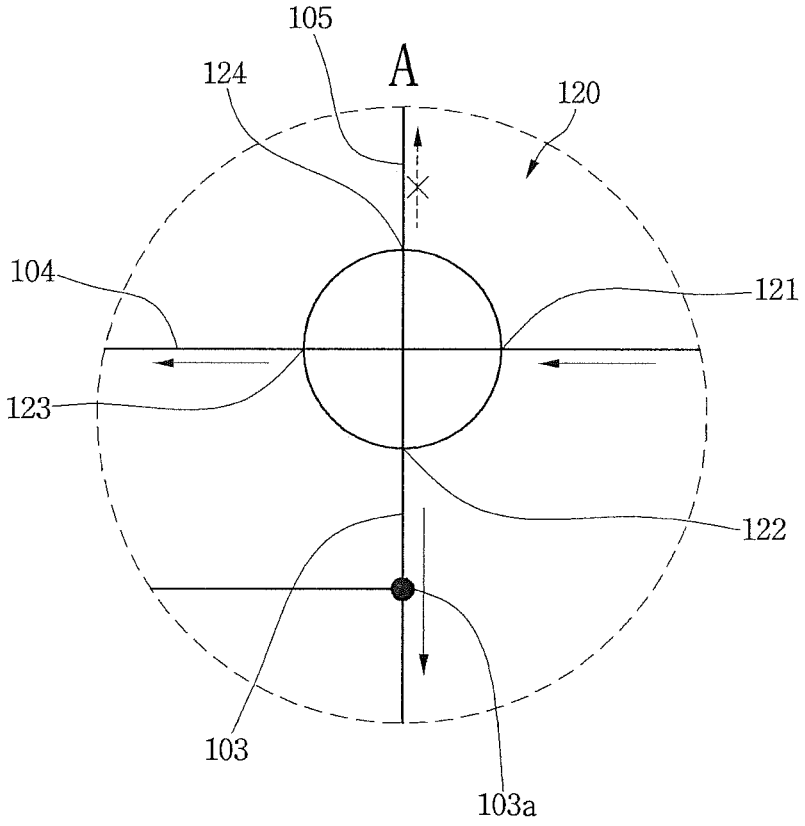
FIG. 6 is a view illustrating a state in which a valve unit operates when the refrigerator performs the first operation mode.

Referring to FIGS. 5 and 6, when the refrigerator performs the first operation mode, i.e., the general mode, the valve unit 120 may be controlled in a predetermined operation mode. The general mode explained above can be understood as an operation mode in which a cooling of the refrigerator compartment 20 or a cooling of the freezer compartment 30 is performed by supplying the refrigerant to at least one evaporator of the first and second evaporators 110 and 150 without the defrosting operation of the second evaporator 150.

For example, FIG. 5 is a view illustrating a state in which a simultaneous cooling of the refrigerator compartment and the freezer compartment is performed by supplying the refrigerant to both of the first and second evaporators 110 and 150. When only the cooling of the refrigerator compartment is required, the refrigerant may flow from the valve unit 120 just into the first evaporator 110, and when only the cooling of the freezer compartment is required, the refrigerant may flow from the valve unit 120 just into the second evaporator 150. Hereinafter, example of the simultaneous cooling case of the refrigerator compartment and the freezer compartment will be described.

When the refrigerator performs the general mode operation, the refrigerant compressed in the compressor 101 is introduced to the inlet part 121 of the valve unit 120 through the condenser 102. The valve unit 120 may be controlled as the first operation mode.

Specifically, the first and second outlet parts 122 and 123 of the valve unit 120 are opened and the third outlet part 124 is closed. Thus, the refrigerant introduced to the valve unit 120 through the inlet part 121 may be branched and discharged to the first and second outlet parts 122 and 123. And, the flow of the refrigerant through the hot gas path 105 is restricted.

The refrigerant discharged from the valve unit 120 is branched to the first and second refrigerant paths 103 and 104, each depressurized in the first and second expanders 103*a* and 104*a*, and introduced to the first and second evaporators 110 and 150. The refrigerant is evaporated at the first and second evaporators 110 and 150, and the cooling air generated during this process may be supplied to each of the refrigerator compartment 20 and the freezer compartment 30. The refrigerant passed through the first and second evaporators 110 and 150 is combined and suctioned to the compressor 101, and passed through the condenser 102 after being compressed by the compressor 101.

Figure 7:
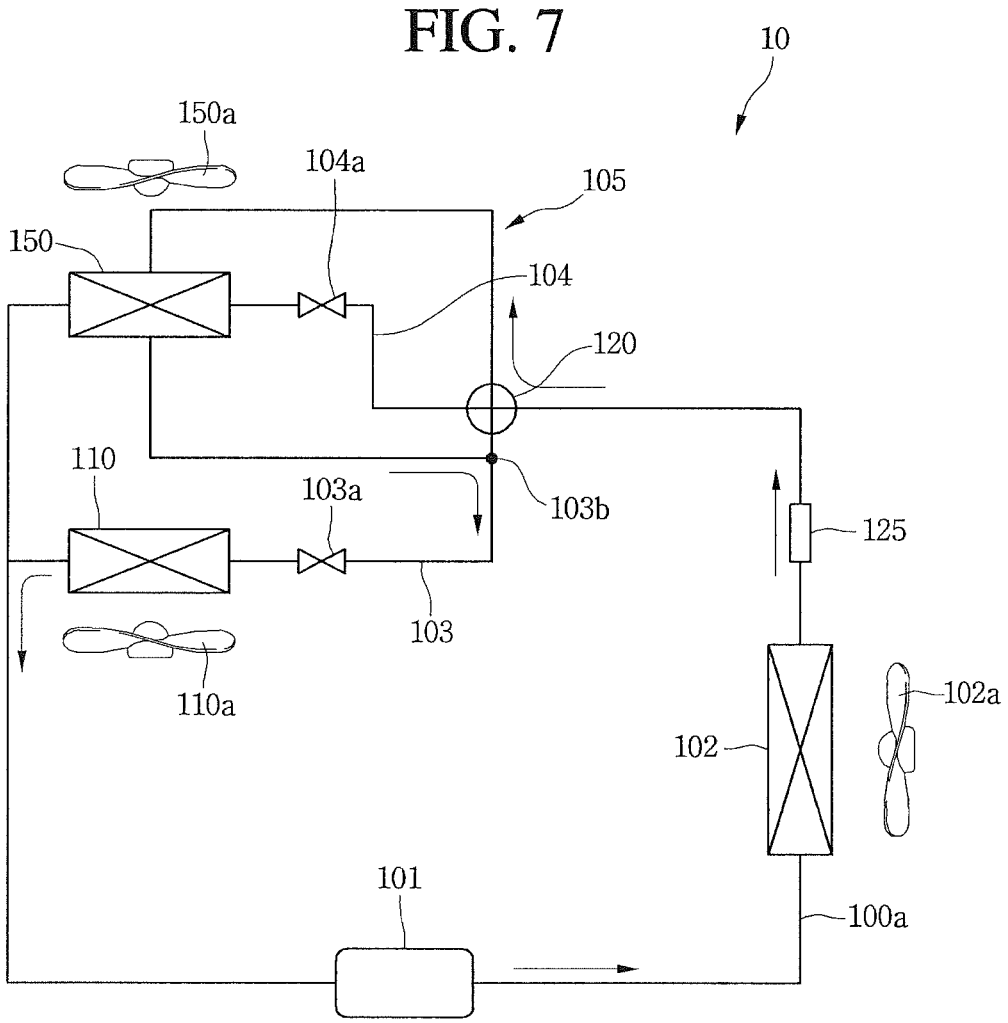
FIG. 7 is a cycle view illustrating the flow of the refrigerant when the refrigerator performs a second operation mode.
Figure 8:
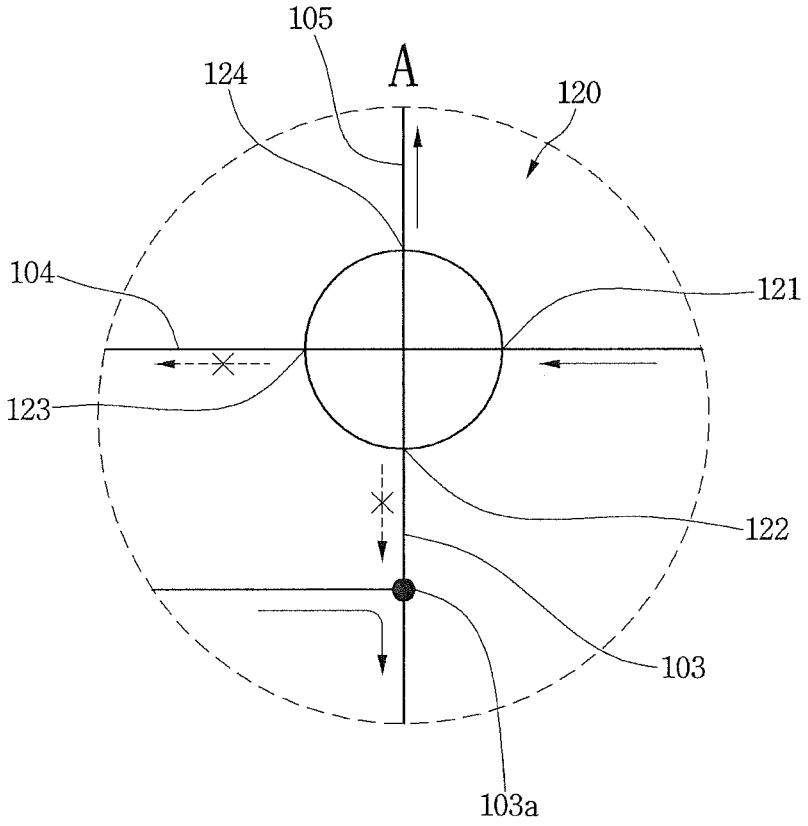
FIG. 8 is a view illustrating a state in which the valve unit operates when the refrigerator performs the second operation mode.

Referring to FIGS. 7 and 8, when the refrigerator performs the defrosting operation of the freezer compartment as the second operation mode, the valve unit 120 may be operated as the second operation mode.

When the refrigerator performs the defrosting operation of the freezer compartment, the refrigerant compressed by the compressor 101 is introduced to the inlet part 121 of the valve unit 120 through the condenser 102.

The first and second outlet parts 122 and 123 of the valve unit 120 are closed and the third outlet part 124 is opened. Thus, the refrigerant introduced to the valve unit 120 through the inlet part 121 may be discharged through the third outlet part 124. The refrigerant discharged from the valve unit 120 flows in the hot gas path 105 and passes through the second evaporator 150. The discharging flow through the first and second outlet parts 122 and 123 of the refrigerant introduced to the valve unit 120 may be restricted by the first and second outlet parts 122 and 123 closed.

During the passing process of the refrigerant of the hot gas path 105 through the second evaporator 150, the ice formed on the second evaporator 150 may be removed. The refrigerant passed through the second evaporator 150 is introduced to the first refrigerant path 103 through the combination part 103*b*, depressurized by the first expander 103*a*, and may be flowed to the first evaporator 110. At this time, the flow of the refrigerant from the combination part 103*b* to the valve unit 120 may be restricted by the first outlet part 122 closed.

The refrigerant is evaporated at the first evaporator 110 and the cooling air generated during this process may be supplied to the refrigerator compartment 20. The refrigerant passed through the first evaporator 110 is suctioned to the compressor 101, compressed by the compressor 101, and passed through the condenser 102. According to this kind of operation, it is possible to perform the cooling of the refrigerator compartment 20 by the operation of the first evaporator 110 during the defrosting of the second evaporator 150. Thus, the cooling efficiency of the refrigerator can be improved.

Due to selective performing of the first operation mode which cools the refrigerator compartment 20 or the freezer compartment 30, and the second operation mode which defrosts the second evaporator 150 by controlling one valve unit 120, it has an effect to control the refrigerator operation by a simple configuration.

In some implementations, frost may be formed on the first evaporator 110 and the defrosting operation of the first evaporator 110 may be required. However, the amount of the frost formed on the second evaporator 150 exposed on a relatively low temperature environment may be greater than the amount of the frost formed on the first evaporator 110 exposed on a relatively high temperature environment.

In this case, the amount of heat required to defrost the second evaporator 150 may be greater than the amount of heat required to defrost the first evaporator 110, and the power consumption by using the heater of related art to defrost the second evaporator 150 may be considerably increased. Thus, it is possible to defrost the second evaporator 150 by using the high temperature refrigerant passed through the condenser 102, and it is possible to defrost the first evaporator 110 by using a conventional heater. Even the heater is used for the first evaporator 110, the power consumption may not be relatively great.

Figure 9:
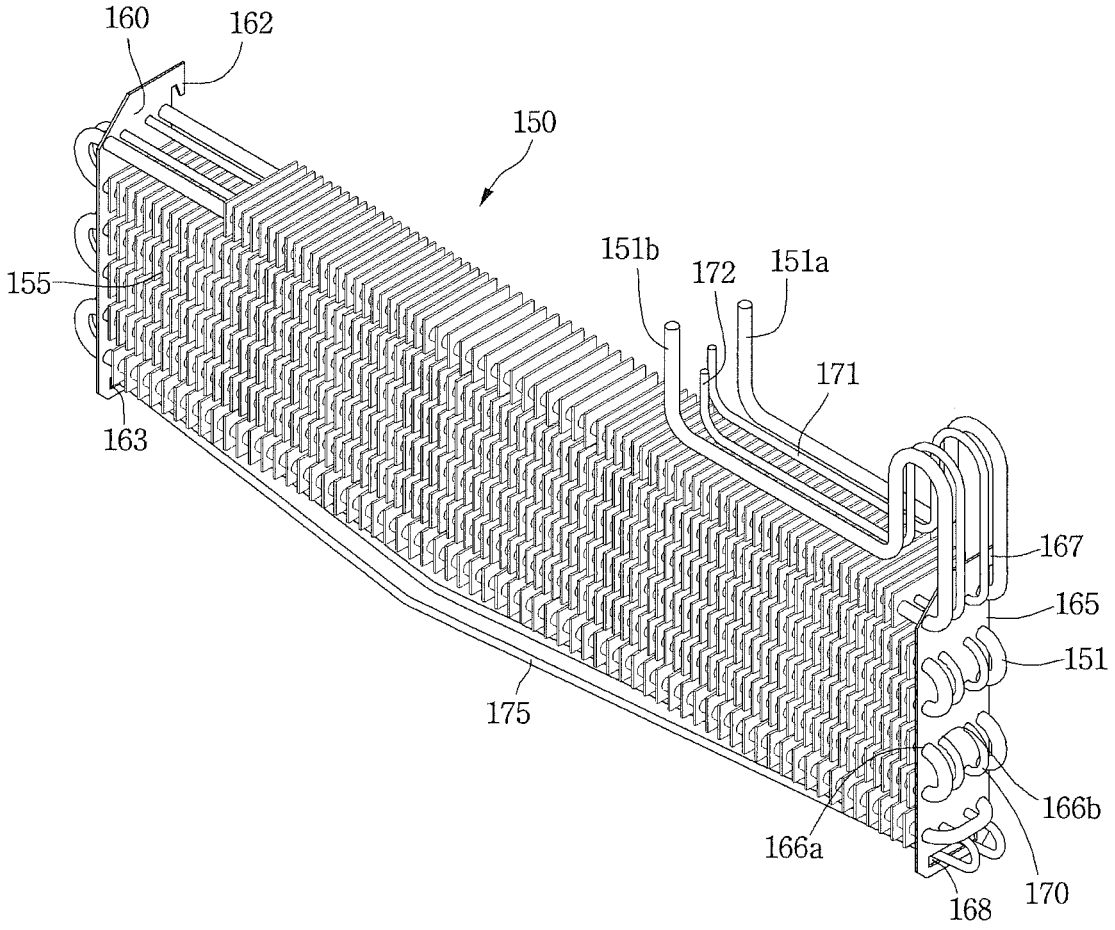
FIG. 9 is a view illustrating a configuration of a second evaporator.
Figure 10:
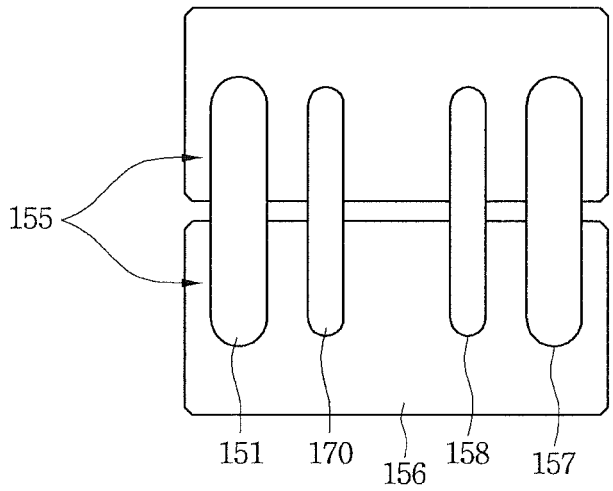
FIG. 10 is a view illustrating a state in which first and second pipes and a fin are coupled to each other.

Referring to FIG. 9, the second evaporator 150 includes a plurality of refrigerant pipes 151 and 170 through which refrigerant having different phases from each other flows, and a fin 155 which is coupled to the plurality of refrigerant pipes 151 and 170 and increases a heat exchange area between the refrigerant and a fluid.

Specifically, the plurality of refrigerant pipes 151 and 170 includes a first pipe 151 through which the refrigerant depressurized in the second expander 104*a* flows, and a second pipe 170 through which the refrigerant condensed in the condenser 102 is supplied. The second pipe 170 forms at least a part of the first hot gas path 105, and may be referred to as a "hot gas pipe". The refrigerant in the second pipe 170 is a refrigerant not depressurized in the second expander 104*a*, that is, the refrigerant bypassed the second expander 104*a*, and may have a higher temperature than that of the refrigerant which flows in the first pipe 151.

The second evaporator 150 further includes coupling plates 160 and 165 which fix the first pipe 151 and the second pipe 170.

Specifically, a plurality of coupling plates 160 and 165 may be provided at both sides of the second evaporator 150. Specifically, the coupling plates 160 and 165 include a first plate 160 which supports one side of each of the first pipe 151 and the second pipe 170, and a second plate 165 which supports the other side of each of the first pipe 151 and the second pipe 170. The first and second plates 160 and 165 may be disposed to be spaced apart from each other.

The first pipe 151 and the second pipe 170 may be formed to be bent in one direction from the first plate 160 toward the second plate 165 and the other direction from the second plate 165 toward the first plate 160.

The first and second plates 160 and 165 serve to fix both sides of the first pipe 151 and the second pipe 170, and to prevent shaking of the first pipe 151 and the second pipe 170. For example, the first pipe 151 and the second pipe 170 may be disposed to pass through the first and second plates 160 and 165.

Each of the first and second plates 160 and 165 has a plate shape which extends longitudinally, and may have through-holes 166*a* and 166*b* through which at least parts of the first pipe 151 and 170 pass. Specifically, the through-holes 166*a* and 166*b* include a first through-hole 166*a* through which the first pipe 151 passes, and the second through-hole 166*b* through which the second pipe 170 passes.

The first pipe 151 may be disposed to pass through the first through-hole 166*a* of the first plate 160, to extend toward the second plate 165, and to pass through the first through-hole 166*a* of the second plate 165, and then a direction thereof may be changed so as to extend again toward the first plate 160.

The second pipe 170 may be disposed to pass through the second through-hole 166*b* of the first plate 160, to extend toward the second plate 165, and to pass through the second through-hole 166*b* of the second plate 165, and then a direction thereof may be changed so as to extend again toward the first plate 160.

The second evaporator 150 includes a first inlet part 151*a* which guides the introduction of the refrigerant into the first pipe 151, and a first outlet part 151*b* which guides the discharge of the refrigerant flowed through the first pipe 151. The first inlet part 151*a* and the first outlet part 151*b* form at least a part of the first pipe 151. For example, two-phase refrigerant depressurized in the second expander 104*a* is introduced into the second evaporator 150 through the first inlet part 151*a* to be evaporated. The refrigerant is discharged from the second evaporator 150 through the first outlet part 151*b*.

The second evaporator 150 includes a second inlet part 171 which guides the introduction of the refrigerant into the second pipe 170, and a second outlet part 172 which guides the discharge of the refrigerant flowed through the second pipe 170. The second inlet part 171 and the second outlet part 172 form at least a part of the second pipe 170.

For example, in the operation mode of defrosting the second evaporator 150, that is, the second operation mode, the high temperature refrigerant condensed in the condenser 102 is introduced to the second evaporator 150 through the second inlet part 171, removes the ice formed on the second evaporator 150 during a heat exchange process, and is discharged from the second evaporator 150 through the second outlet part 172.

A plurality of fins 155 are provided to be spaced apart from each other. The first pipe 151 and the second pipe 170 are disposed to pass through the plurality of fins 155. Specifically, the fins 155 may be disposed to vertically and horizontally form a plurality of rows.

The coupling plates 160 and 165 include the hooks 162 and 167 which are coupled to the inner case 13. The hooks 162 and 167 are disposed at upper portions of the coupling plates 160 and 165, respectively. Specifically, the hooks 162 and 167 include a first hook 162 which is provided at the first plate 160, and a second hook 167 which is provided at the second plate 165.

First and second support parts 163 and 168 through which the second pipe 170 passes are formed at the coupling plates 160 and 165, respectively. The first and second support parts 163 and 168 are disposed at lower portions of the coupling plates 160 and 165, respectively. Specifically, the first and second support parts 163 and 168 include a first support part 163 which is provided at the first plate 160, and a second support part 168 which is provided at the second plate 165.

The second pipe 170 includes an extension part 175 which forms a lower end of the second evaporator 150. Specifically, the extension part 175 is formed to extend downward further than a lowermost fin 155 of the plurality of fins 155. The extension part 175 is located inside a water collection part 180 (referring to FIG. 11) which will be described later, and may supply heat to remaining frost in the water collection part 180. Defrosted water may be drained to a machinery compartment 50.

Due to the extension part 175, the second pipe 170 may have a shape which is inserted into the first and second support parts 163 and 168 and extends to a central portion of the second evaporator 150. That is, due to a configuration in which the second pipe 170 passes and extends through the first and second support parts 163 and 168, the extension part 175 may be stably supported by the second evaporator 150.

The first pipe 151 and the second pipe 170 may be installed to pass through the plurality of fins 155. The plurality of the fins 155 may be disposed to be spaced apart from each other at a predetermined distance. Specifically, each of the fins 155 includes a fin body 156 having an approximately quadrangular plate shape, and a plurality of through-holes 157 and 158 which are formed at the fin body 156 and through which the first pipe 151 and the second pipe 170 pass. The plurality of through-holes 157 and 158 includes a first through-hole 157 through which the first pipe 151 passes, and a second through-hole 158 through which the second pipe 170 passes. The plurality of through-holes 157 and 158 may be disposed in one row.

An inner diameter of the first through-hole 157 may have a size different from that of an inner diameter of the second through-hole 158. For example, the inner diameter of the first through-hole 157 may be formed larger than that of the second through-hole 158. In other words, an outer diameter of the first pipe 151 may be formed larger than that of the second pipe 170.

This is because the first pipe 151 guides the flow of the refrigerant which performs an innate function of the second evaporator 150, and thus a relatively large flow rate of the refrigerant is required. However, since the second pipe 170 guides the flow of the high temperature refrigerant for a predetermined time only when the defrosting operation of the second evaporator 150 is required, a relatively small flow rate of the refrigerant is required.

Figure 11:
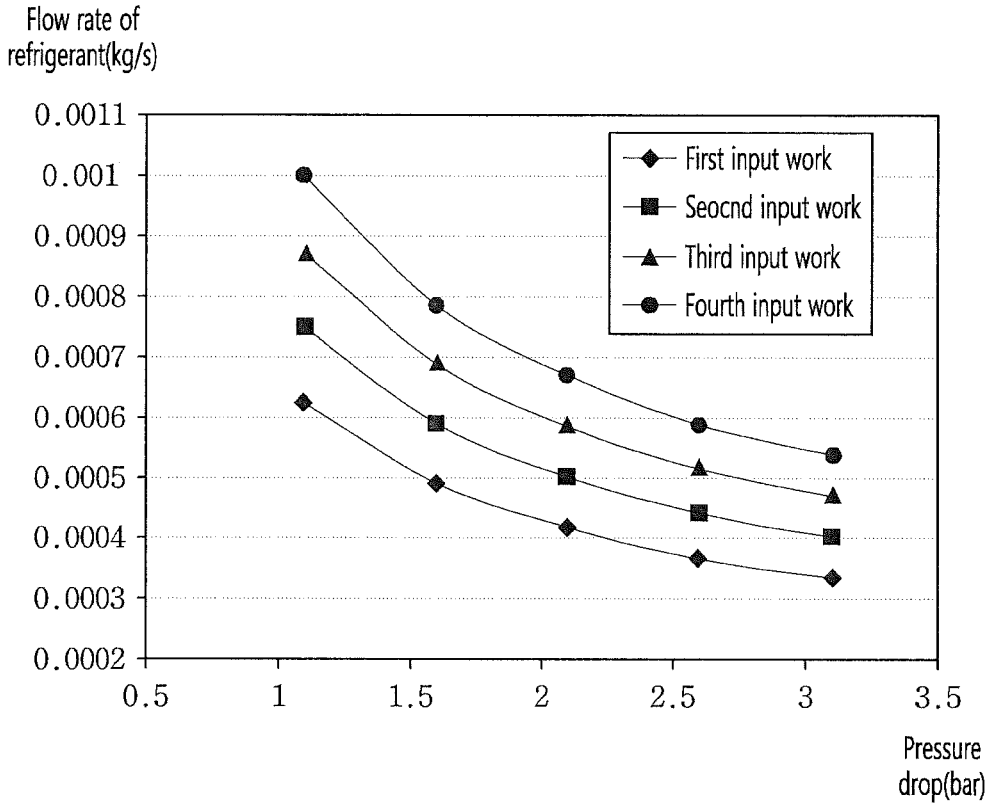
FIGS. 11 to 14 are graphs illustrating results of an experiment performed under preset conditions in the refrigerator.

FIG. 11 is an experimental graph illustrating a change of the flow rate kg/s of the refrigerant which circulates in the refrigeration cycle of the refrigerator 10 according to an increase in a pressure drop bar with respect to a predetermined input work of the compressor 101.

An experiment is performed four times while the input work of the compressor 101 is changed. The input work is increased from a first input work to a fourth input work of the compressor 101. For example, a second input work may be determined larger by 20% than the first input work, a third input work may be determined larger by 40% than the first input work, and the fourth input work may be determined larger by 60% than the first input work. This definition may be equally applied to FIG. 12

A pressure drop of a transverse axis indicates a pressure which is reduced in the first expander 103*a* after defrosting the second evaporator 150 but before being introduced into the first evaporator 110. Based on a predetermined pressure drop, it may be understood that a flow rate of the refrigerant is increased as the input work of the compressor 101 is increased.

As the pressure drop becomes smaller, the flow rate of the refrigerant may be increased. That is, as an opening degree of the first expander 103*a* is increased, the pressure drop may be reduced, but the flow rate of the refrigerant may be increased. For example, when the first expander 103*a* is formed of a capillary tube, as a diameter of the capillary tube becomes larger or a length of the capillary tube becomes shorter, the pressure drop may be reduced, and the flow rate of the refrigerant may be increased.

Figure 12:
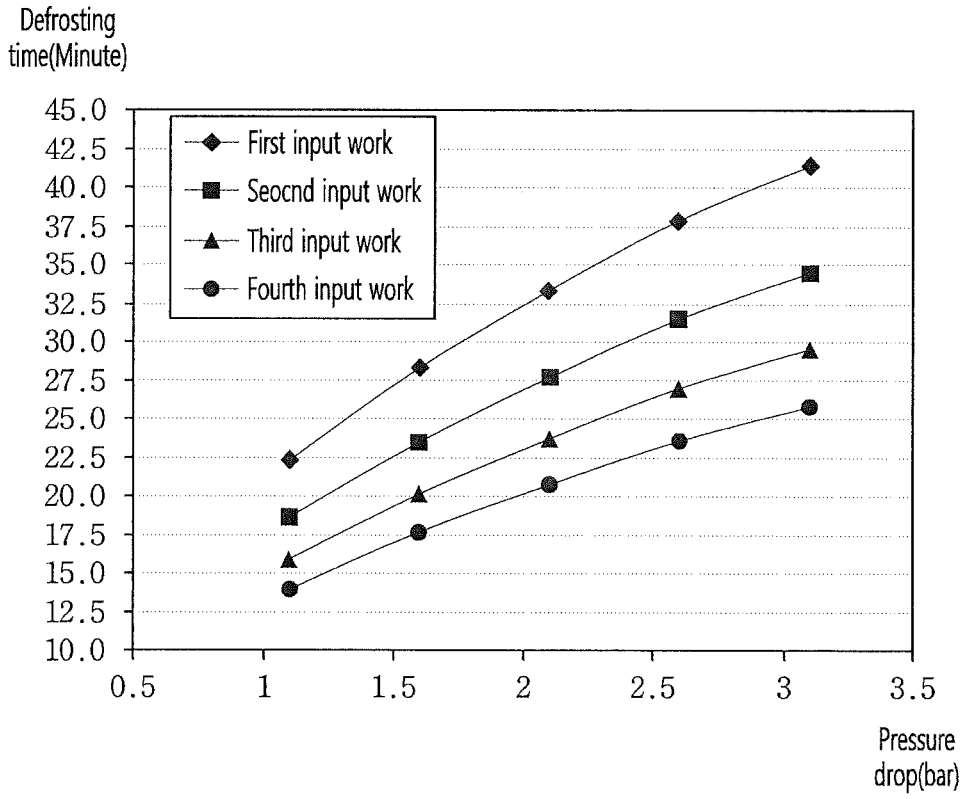

Referring to FIG. 12, as the pressure drop becomes smaller, a defrosting time becomes shorter. That is, as the pressure drop becomes smaller, the flow rate of the refrigerant flowing through the hot gas path 105 is increased. Accordingly, the defrosting performance is improved, and thus the defrosting time becomes shorter. As the work input to the compressor 101 is increased, the flow rate of the refrigerant circulating the system is increased, and the defrosting time may be shorter.

As the pressure drop becomes smaller, the flow rate of the refrigerant may be increased, and the defrosting time may be shorter. However, when the pressure drop is too small, an evaporation temperature of the evaporator which does not perform the defrosting operation, i.e. the first evaporator 110 is relatively increased, and the cooling operation may not be effectively performed.

Figure 13:
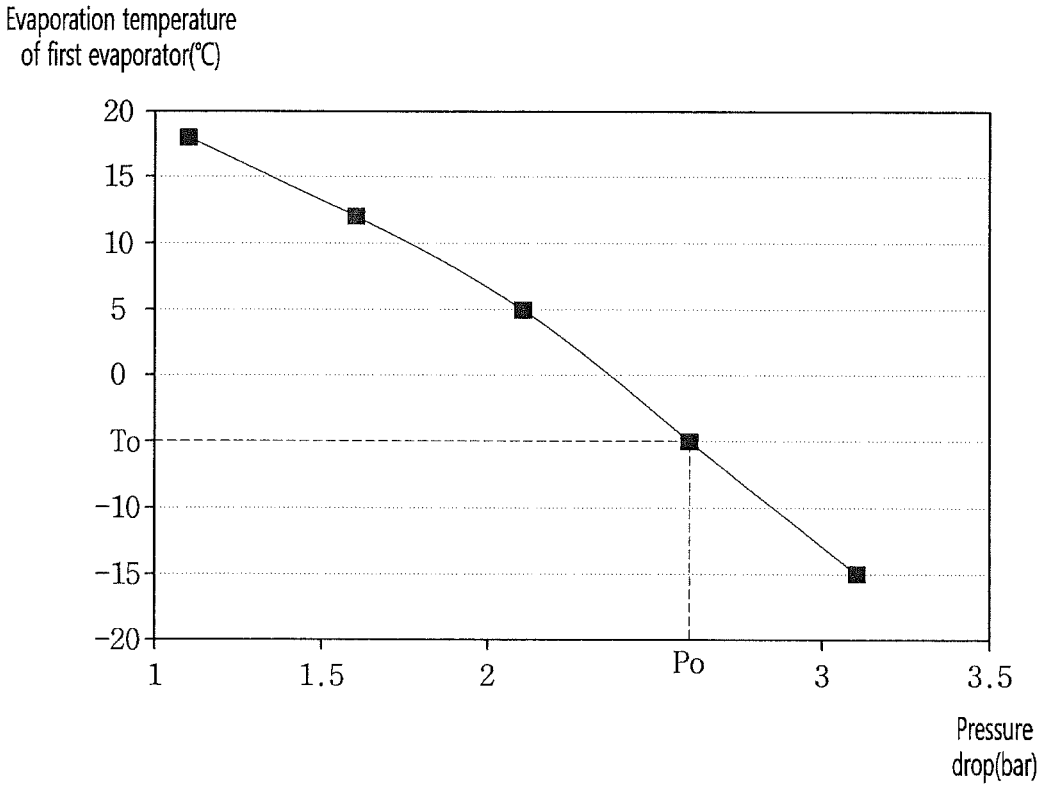

Referring to FIG. 13, it may be understood that an evaporation temperature of the evaporator for the cooling operation which is indicated at a vertical axis is reduced, as the pressure drop of the horizontal axis is increased.

In order to maintain the evaporator temperature of the first evaporator 110 for the cooling operation at a set value To or less while ensuring the defrosting performance having a set level or more, the refrigerator 10 may be designed so that the pressure drop is maintained at a set value Po or more. That is, the length or an inner diameter of the first expander 103*a* may be determined so that the pressure drop is maintained at the set value Po or more. For example, the set value To of the evaporation temperature may be about −5° C., and the set value Po of the pressure drop may be about 2.5 bar.

Figure 14:
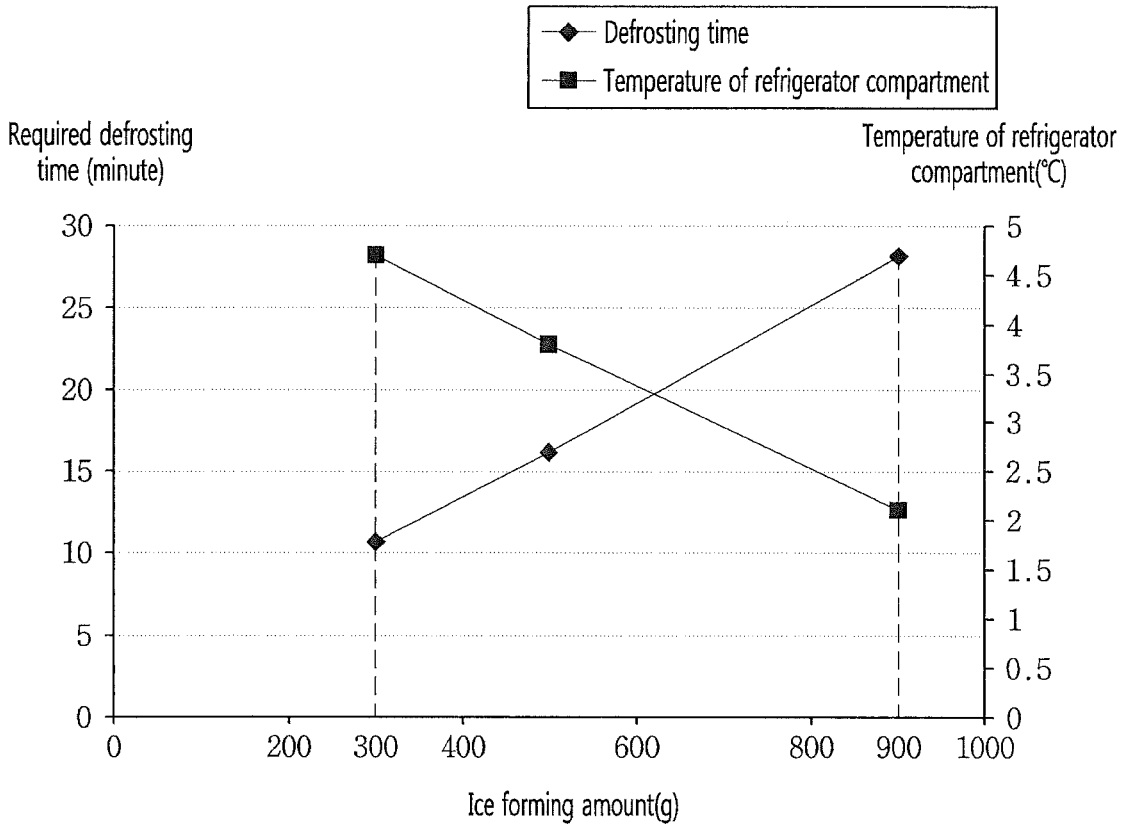

FIG. 14 is a graph illustrating a change in a temperature of the refrigerator compartment after the defrosting operation is terminated and the defrosting time required according to an ice forming amount on the freezer compartment evaporator 150 when the refrigerator 10 is operated in the freezer compartment defrosting mode.

Referring to FIG. 14, the graph illustrates a change in a temperature of the refrigerator compartment after the defrosting operation is terminated and the defrosting time required according to an ice forming amount on the freezer compartment evaporator 150 when the refrigerator 10 is operated in the freezer compartment defrosting mode.

Specifically, as the ice forming amount on the freezer compartment evaporator 150 becomes smaller, the defrosting time is reduced, and a temperature of the refrigerator compartment 20 may be increased after the defrosting operation is terminated. For example, when the ice of less than 300 g is formed on the freezer compartment evaporator 150 (an ice forming amount of 300 g), a time required for the defrosting operation is about 10 minutes, and the temperature of the refrigerator compartment 20 after the defrosting operation is terminated is about 4.7° C. When the ice forming amount is 500 g, the time required for the defrosting operation is about 16 minutes, and the temperature of the refrigerator compartment 20 after the defrosting operation is terminated is about 3.8° C. When the ice forming amount is 900 g, the time required for the defrosting operation is about 28 minutes, and the temperature of the refrigerator compartment 20 after the defrosting operation is terminated is about 2.1° C.

When the ice forming amount on the freezer compartment evaporator 150 is too much, the defrosting time may be increased. While the freezer compartment evaporator 150 is defrosted, a condensing temperature of the refrigerant flowing through the hot gas path 105 becomes too low, and the evaporation temperature of the refrigerator compartment evaporator 110 becomes low, and thus the temperature of the refrigerator compartment 20 is lowered less than a set value.

However, as illustrated in the graph of FIG. 14, when the ice forming amount on the freezer compartment evaporator 150 is about 900 g, the temperature of the refrigerator compartment 20 is about 2° C. When it is considered that the temperature of the refrigerator compartment 20 is formed within a range of 0 to 5° C., it may be understood that a temperature range of 2° C. accords with a required level.

Figure 15:
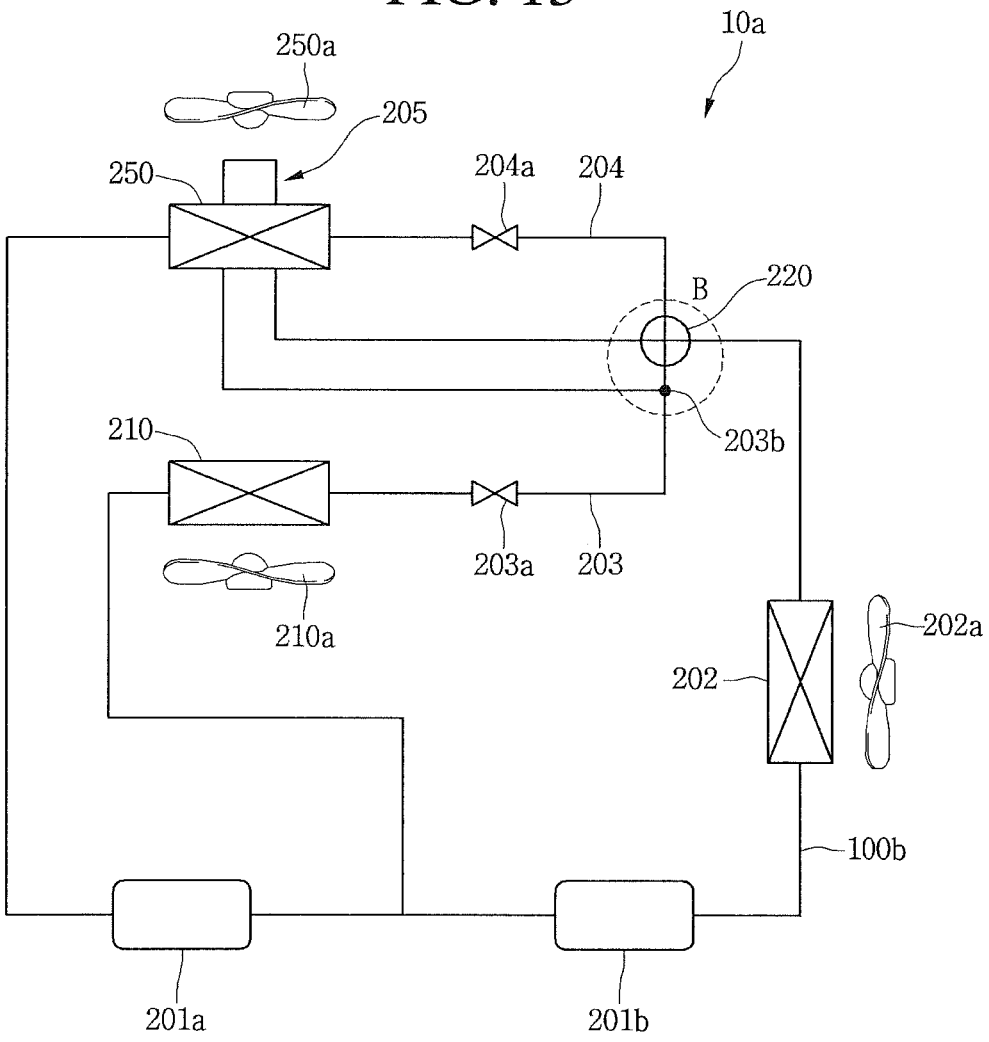
FIG. 15 illustrates an example of cycle of a refrigerator.
Figure 16:
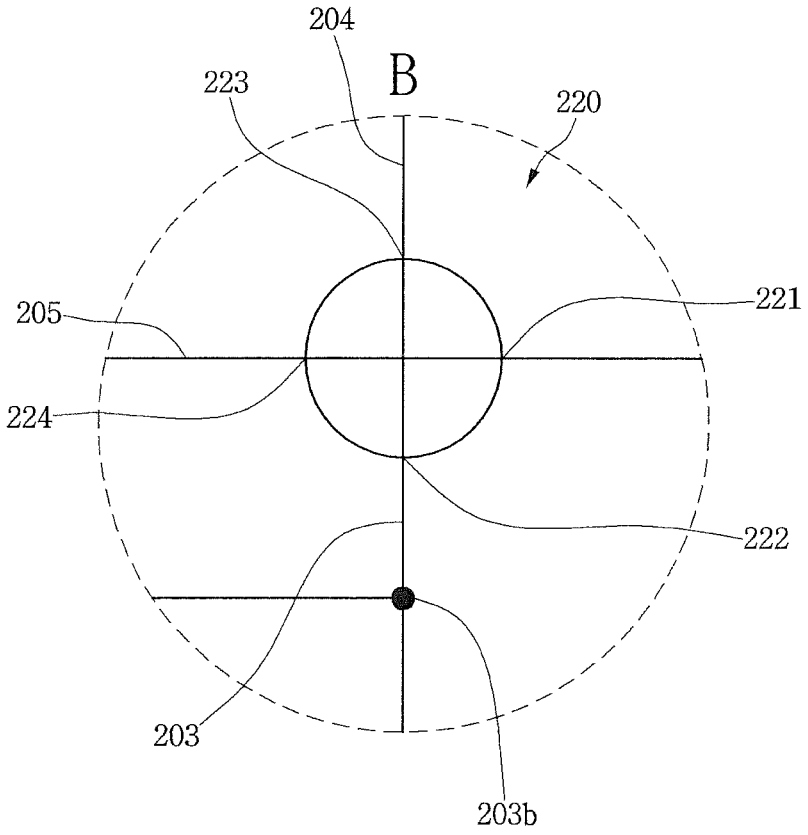
FIG. 16 is an enlarged view of a B portion of FIG. 15.

Referring to FIG. 15, a refrigerator 10*a* may include a plurality of compressors 201*a* and 201*b* which compress a refrigerant, a condenser 202 which condenses the refrigerant compressed by the plurality of compressors 201*a* and 201*b*, a plurality of expanders 203*a* and 204*a* which depressurize the refrigerant condensed by the condenser 202, and a plurality of evaporators 210 and 250 which evaporate the refrigerant depressurized by the plurality of expanders 203*a* and 204*a*.

The refrigerator 10*a* further includes a refrigerant pipe 100*b* which connects the compressors 201*a* and 201*b*, the condenser 202, the expanders 203*a* and 204*a*, and the evaporators 210 and 250, and guides a flow of the refrigerant.

The plurality of compressors 201*a* and 201*b* include a first compressor 201*a* disposed at a low pressure side, and a second compressor 201*b* disposed at a high pressure side. The second compressor 201*b* is installed at an outlet part of the first compressor 201*a* and configured to compress by two stage the refrigerant compressed by single stage in the first compressor 201*a*.

The plurality of evaporators 210 and 250 include a first evaporator 210, as an evaporator of a refrigerator compartment, which generates and supplies a cooling air to the refrigerator compartment 20, and a second evaporator 250, as an evaporator of a freezer compartment, which generates and supplies a cooling air to the freezer compartment 30. The first and second evaporators 210 and 250 are connected in parallel.

An outlet pipe of the first evaporator 210 is connected to an inlet part of the second compressor 201 band, an outlet pipe of the second evaporator 250 is connected to an inlet part of the first compressor 201*a*. For example, the refrigerant compressed by single stage in the first compressor 201*a* may be combined with the refrigerant passed through the first evaporator 210, suctioned to the second compressor 201*b*, and compressed by two stage in the second compressor 201*b*.

The plurality of expanders 203*a* and 204*a* include a first expander 203*a* which expands the refrigerant to be introduced to the first evaporator 210, and a second expander 204*a* which expands the refrigerant to be introduced to the second evaporator 250. The first and second expanders 203*a* and 204*a* may include a capillary tube.

To set an evaporation pressure of the refrigerant in the second evaporator 250 less than that of the refrigerant in the first evaporator 210, a diameter of the capillary tube in the second expander 204*a* may be smaller than that of the capillary tube in the first expander 203*a*.

The refrigerator 10*a* includes a first refrigerant path 203 and a second refrigerant path 204 branched from the refrigerant pipe 100*b*. The first refrigerant path 203 is connected to the first evaporator 210, and the second refrigerant path 204 is connected to the second evaporator 250. And the first expander 203*a* is installed at the first refrigerant path 203, and the second expander 204*a* is installed at the second refrigerant path 204.

The refrigerator 10*a* further includes a valve unit 220 which is configured to branch and introduce a refrigerant to the first and second refrigerant paths 203 and 204. The valve unit 220 may control a flow of the refrigerant so that the first and second evaporators 210 and 250 can be operated simultaneously or singly in a first operation mode of the refrigerator, that is, the refrigerant should be introduced to at least one evaporator of the first and second evaporators 210 and 250.

The refrigerator 10*a* further includes a hot gas path 205 which guides such that a hot temperature refrigerant passed through the condenser 202 is supplied to the second evaporator 250 and performs a defrosting of the second evaporator 250. The hot gas path 205 may be configured to extend to the second evaporator 250 from the valve unit 220, and be connected to the second refrigerant path 203 via the second evaporator 250.

The first refrigerant path 203 includes a combination part 203*b* which connects to the hot gas path 205. That is, one end part of the hot gas path 205 may be connected to a third outlet part 224 of the valve unit 220, and the other end part may be connected to the combination part 203*b* of the first refrigerant path 203.

The valve unit 220 includes an inlet part 221 into which a refrigerant is introduced, and a three-way valve having three outlet parts 222, 223, and 224 from which the refrigerant is discharged.

The inlet part 221 guides the refrigerant passed through the condenser 202 to be introduced to the valve unit 220. The three outlet parts 222, 223, and 224 include a first outlet part 222 which guides the refrigerant introduced to the valve unit 220 through the inlet part 221 to be discharged to the first refrigerant path 203. That is, the first outlet part 222 may be connected to the first refrigerant path 203.

The three outlet parts 222, 223, and 224 further include a second outlet part 223 which guides the refrigerant introduced to the valve unit 220 to be discharged to the second refrigerant path 204. That is, the second outlet part 223 may be connected to the second refrigerant path 204. And, the three outlet parts 222, 223, and 224 further include the third outlet part 224 which guides the refrigerant introduced to the valve unit 220 to be discharged to the hot gas path 205. That is, the third outlet part 224 may be connected to the hot gas path 205.

The refrigerant introduced to the inlet part 221 of the valve unit 220 may be discharged to at least one outlet part of the first and second outlet parts 222 and 223 in the first operation mode of the refrigerator. When the first operation mode of the refrigerator is performed, the valve unit 220 may be controlled to close the third outlet part 224.

For example, when a simultaneous cooling mode is performed in the first operation mode of the refrigerator, the refrigerant may be branched and discharged to the first and second outlet parts 222 and 223, each may flow in the first and second refrigerant paths 203 and 204, and may be introduced to the first and second evaporators 210 and 250.

As another example, when a refrigerator compartment cooling mode is performed in the first operation mode of the refrigerator, the refrigerant may be discharged through the first outlet part 222, may flow in the first refrigerant path 203, and may be introduced to the first evaporator 210. At this time, the second outlet part 223 is closed, and a refrigerant flow through the second refrigerant path 204 is restricted.

As still other example, when a freezer compartment cooling mode is performed in the first operation mode of the refrigerator, the refrigerant may be discharged through the second outlet part 223, may flow in the second refrigerant path 204, and may be introduced to the second evaporator 250. At this time, the first outlet part 222 is closed, and a refrigerant flow through the first refrigerant path 203 is restricted.

The refrigerator 10*a* further includes fans 202*a*, 210*a*, and 250*a* which are provided at one side of a heat exchanger to blow air. The fans 202*a*, 210*a*, and 250*a* include a condensing fan 202*a* provided at one side of the condenser 202, a first evaporating fan 210*a* provided at one side of the first evaporator 210, and a second evaporating fan 250*a* provided at one side of the second evaporator 250.

Figure 17:
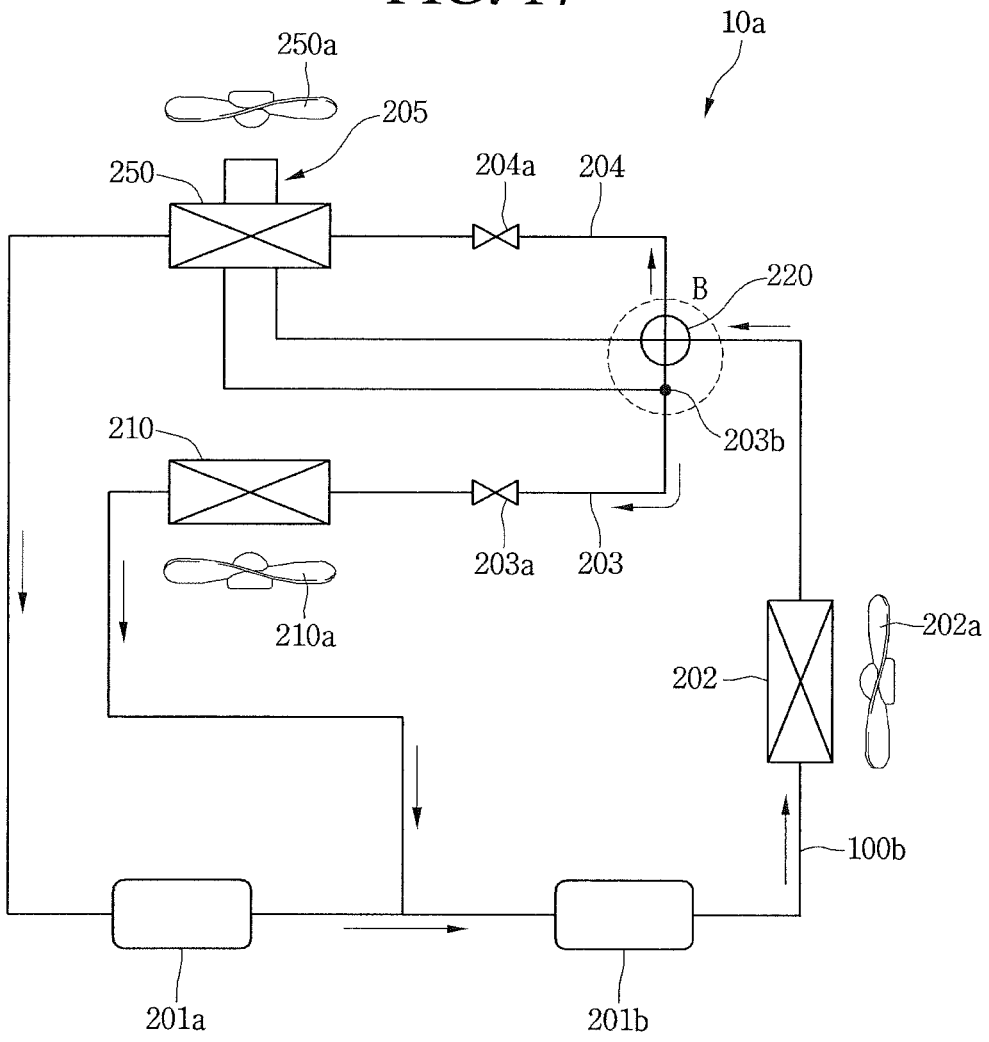
FIG. 17 is a cycle view illustrating a flow of a refrigerant when the refrigerator performs a first operation mode.
Figure 18:
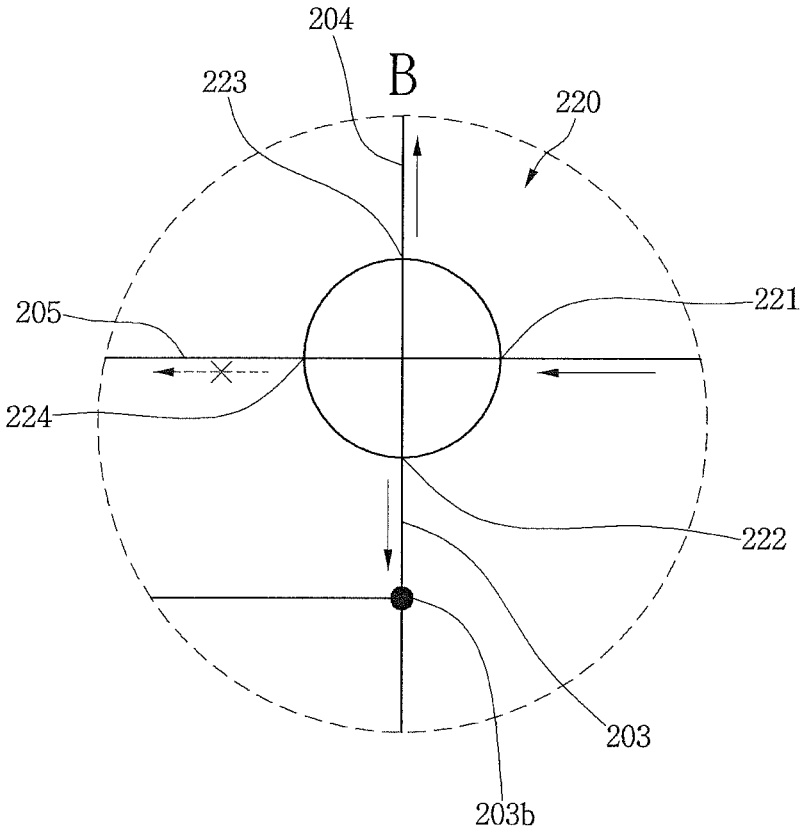
FIG. 18 is a view illustrating a state in which a valve unit operates when the refrigerator performs the first operation mode.

Referring to FIGS. 17 and 18, when the refrigerator performs a general mode as the first operation mode, the valve unit 220 may be controlled in a predetermined operation mode. The general mode is understood as an operation mode in which a cooling of the refrigerator compartment 20 or a cooling of the freezer compartment 30 is performed by supplying a refrigerant to at least one evaporator of the first and second evaporators 210 and 250 without a defrosting operation of the second evaporator 250 as described above.

For example, FIG. 17 is a view illustrating a state in which a simultaneous cooling of the refrigerator compartment and the freezer compartment is performed by supplying the refrigerant to all of the first and second evaporators 210 and 250. When only a cooling of the refrigerator compartment is required, the refrigerant may be flowed from the valve unit 220 to the first evaporator 210, and when only a cooling of the freezer compartment is required, the refrigerant may be flowed from the valve unit 220 to the second evaporator 250. Hereinafter, a case which the simultaneous cooling of the refrigerator compartment and the freezer compartment is performed is described as an example.

The refrigerant compressed in the compressors 201*a* and 201*b* is introduced to the inlet part 221 of the valve unit 220 through the condenser 202 in the general operation mode of the refrigerator. The valve unit 220 may be controlled in the first operation mode.

Specifically, the first and second outlet parts 222 and 223 of the valve unit 220 are opened, and the third outlet part 224 is closed. Thus, the refrigerant introduced to the valve unit 220 through the inlet part 221 may be branched and discharged to the first and second outlet parts 222 and 223. A flow of the refrigerant through the hot gas path 205 is restricted.

The refrigerant discharged from the valve unit 220 is branched to the first and second refrigerant paths 203 and 204, depressurized by each of the first and second expanders 203*a* and 204*a*, and introduced to the first and second evaporators 210 and 250.

The refrigerant is evaporated in the first and second evaporators 210 and 250, and the cooling air generated during this process may be supplied to each of the refrigerator compartment 20 and the freezer compartment 30. The refrigerant passed through the second evaporator 250 is suctioned to the first compressor 201*a* and compressed by single stage, and combined with the refrigerant passed through the first evaporator 210. The combined refrigerant may be suctioned to the second compressor 201*b* and compressed by two stage. The refrigerant compressed by the second compressor 201*b* flows to the condenser 202.

Figure 19:
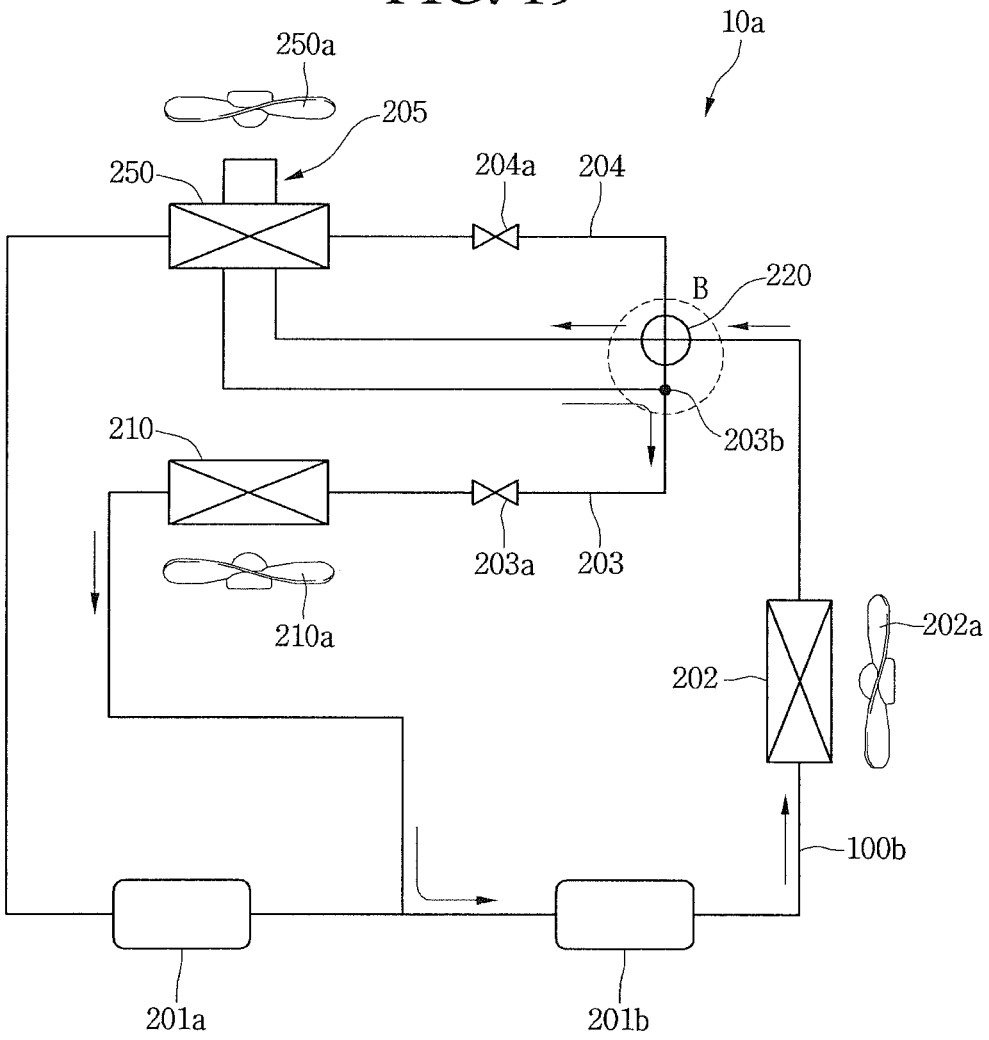
FIG. 19 is a cycle view illustrating the flow of the refrigerant when the refrigerator performs a second operation mode.
Figure 20:
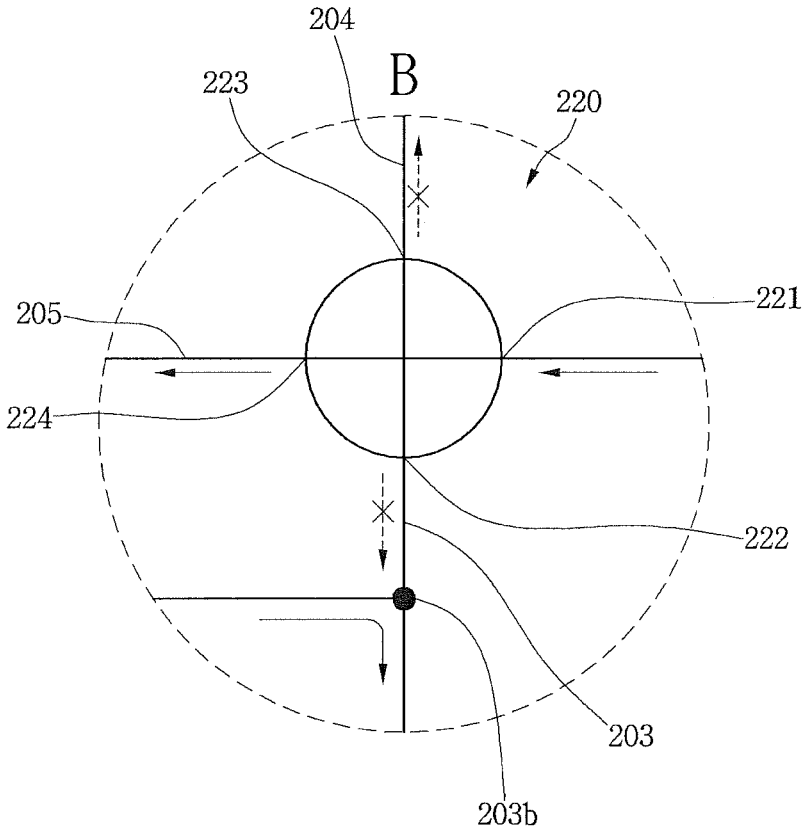
FIG. 20 is a view illustrating a state in which a second valve unit operates when a refrigerator performs a second operation mode.

Referring to FIGS. 19 and 20, when the refrigerator performs a freezer compartment defrosting mode as a second operation mode, the valve unit 220 may be operated in the second operation mode. The refrigerant compressed by the second compressor 201*b* passes through the condenser 202 and is introduced to the inlet part 121 of the valve unit 220 in the freezer compartment defrosting mode of the refrigerator.

The first and second outlet parts 222 and 223 of the valve unit 220 are closed, and the third outlet part 224 is opened. Thus, the refrigerant introduced to the valve unit 220 through the inlet part 221 may be discharged through the third outlet part 224. The refrigerant discharged from the valve unit 220 flows in the hot gas path 205 and passes through the second evaporator 250. By the first and second outlet parts 222 and 223, a discharging flow through the first and second outlet parts 222 and 223 of the refrigerant introduced to the valve unit 220 may be restricted.

While the refrigerant in the hot gas path 205 passes through the second evaporator 250, ice formed at the second evaporator 250 may be removed. The refrigerant passed through the second evaporator 250 may be introduced to the first refrigerant path 203 through the combination part 203*b*, be depressurized at the first expander 203*a*, and flow to the first evaporator 210. At this time, by the closed first outlet part 222, a flow of the refrigerant from the combination part 203*b* to the valve unit 220 may be restricted.

The refrigerant is evaporated at the first evaporator 210, and a cooling air generated during this process may be supplied to the refrigerator compartment 20. And the refrigerant passed through the first evaporator 210 is suctioned to the second compressor 201*b*, is compressed in the second compressor 201*b*, and the passes through the condenser 102.

According to this kind of action, during a defrosting process of the second evaporator 250, a cooling of the refrigerator compartment 20 may be performed by an operation of the first evaporator 210 so that the cooling efficiency of the refrigerator may be improved. And, by controlling the single valve unit 220, the first operation mode which cools the refrigerator compartment 20 or the freezer compartment 30, and the second operation mode which defrosts the second evaporator 250 can be performed selectively. That is, it has an effect to control the operation of the refrigerator by a simple configuration.

When the refrigerator 10*a* performs a refrigerator compartment defrosting mode as a third operation mode, the valve unit 220 is operated in the third operation mode, and a natural defrosting of the first evaporator 210 may be performed. In a case in which two compressors 201*a* and 201*b* perform a two-stage compression, an evaporating temperature of the first evaporator 210 disposed at a high pressure side is formed to be high. For example, the evaporating temperature of the first evaporator 210 may be formed in the range between −5° C. to 0° C. Thus, an amount of frost at the first evaporator 210 may be small and the state of the frosting may be not so bad.

A defrosting of the first evaporator 210 may be performed by supplying a cooling air present in the refrigerator compartment 20 to the first evaporator 210, without using an additional high temperature refrigerant (hot gas). Specifically, when the refrigerator compartment defrosting mode of the refrigerator is performed, the refrigerant compressed by the first and second compressors 201*a* and 201*b* is introduced to the valve unit 220 by passing through the condenser 202.

By controlling a second valve unit 230 in the third operation mode, it may be controlled to open the second outlet part 223 of the plurality of outlet parts 222, 223, and 224, and close the first and third outlet parts 222 and 224. The refrigerant introduced to the inlet part 221 of the valve unit 220 is discharged through the second outlet part 223, and flows in the second refrigerant path 204. The refrigerant is depressurized in the second expander 204*a* and introduced to the second evaporator 250. The refrigerant introduced to the second evaporator 250 is evaporated, and a cooling air generated in the second evaporator 250 during this process may cool the freezer compartment 30.

Meanwhile, a flow of the refrigerant through the first refrigerant path 203 and the hot gas path 205 may be restricted. However, the first evaporating fan 210*a* is operated, and according to this operation, the cooling air present in the refrigerator compartment 20 is circulated in the first evaporator 210 and the refrigerator compartment 20. During this process, the defrosting of the first evaporator 210 may be performed by the cooling air in the refrigerator compartment 20 with a relatively high temperature (natural defrosting).

In case of the defrosting operation of the first evaporator 210, the cooling operation of the freezer compartment 30 can be performed so that the degrading of the cooling performance of the refrigerator may be prevented. Compared with a defrosting operation using a hot gas, the temperature of the first evaporator 210 may be maintained relatively low by a natural defrosting so that evaporating performance may be improved when the first evaporator 210 is operated after completion of the defrosting.

In particular, since the high temperature refrigerant passed through a condenser can flow to one evaporator which will be defrosted, can perform a defrosting operation, can be condensed during the defrosting operation, and then can be evaporated at the other evaporator, cooling of the storage compartment in which the other evaporator is installed can be performed.

For example, when the defrosting operation for an evaporator of a freezer compartment is performed, the refrigerant which is condensed in the evaporator of the freezer compartment can be expanded again, can flow to an evaporator of a refrigerator compartment, and can evaporate.

Thus, the condensing temperature of the refrigerant can be reduced during the flowing of the refrigerant in the evaporator of the freezer compartment and cooling efficiency in the evaporator of the refrigerator compartment can be improved by evaporating in the evaporator of the refrigerator compartment after condensing.

In addition, the evaporator includes the first pipe through which the refrigerant to be evaporated flows, the second pipe through which the high temperature refrigerant flows, and the fin which is coupled to the first and second pipes, and thus in the defrosting operation, the ice formed on the evaporator can be removed using the high temperature refrigerant, and thus defrosting efficiency can be improved.

The defrosting of the evaporator is performed in a convection current method or a radiant method using the defrosting heater, the heat of the high temperature refrigerant can be transferred to the evaporator in a heat conduction method, and the defrosting efficiency is improved, and thus the defrosting time becomes shorter, and a temperature of the storage compartment can be prevented from being excessively increased during the defrosting operation.

What is claimed is:

1. A refrigerator comprising:

a plurality of compressors that are configured to compress a refrigerant, the plurality of compressors including a first compressor in which the refrigerant is single-stage compressed and a second compressor in which the refrigerant is two-stage compressed;

a connection pipe that is configured to connect the first compressor to the second compressor;

a condenser that is configured to condense the refrigerant compressed in the second compressor;

a four-way valve provided at an outlet pipe of the condenser, the four-way valve including an inlet in which the refrigerant passing through the condenser is introduced, a first outlet, a second outlet, and a third outlet;

a first refrigerant path in which a first evaporator is installed, the first refrigerant path being configured to connect with the first outlet and including a first join part;

a second refrigerant path in which a second evaporator is installed, the second refrigerant path being configured to connect with the second outlet;

a first expander that is installed at the first refrigerant path;

a second expander that is installed at the second refrigerant path;

the first evaporator provided at one side of a refrigerator compartment, and that is configured to evaporate the refrigerant depressurized in the first expander;

the second evaporator provided at one side of a freezer compartment, and that is configured to evaporate the refrigerant depressurized in the second expander, the second evaporator including first and second pipes in which the refrigerant is configured to flow;

a hot gas path that is configured to connect the four-way valve to the second evaporator, and that is configured to guide flow of the refrigerant that has passed through the condenser, wherein the first refrigerant path is configured to extend from the first outlet toward a second join part of the connection pipe, wherein the second refrigerant path is connected to the first pipe of the second evaporator and the hot gas path is configured to extend from the third outlet of the four-way valve toward the first join part of the first refrigerant path via the second pipe of the second evaporator, and wherein, while defrosting of the second evaporator is being performed, the four-way valve is configured to operate in a second operation mode based on the first and second outlet parts being closed and the third outlet part being opened such that the refrigerant condensed at the condenser flows into the second pipe of the second evaporator.

2. The refrigerator according to claim 1, wherein, in a first operation mode, the four-way valve is configured to operate when at least one outlet part of the first or second outlet parts is opened, and the third outlet part is closed.

3. The refrigerator according to claim 2, wherein, in an operation mode for cooling the refrigerator compartment of the first operation mode, the four-way valve is configured to operate based on the first outlet part being opened and the second outlet part being closed.

4. The refrigerator according to claim 2, wherein, in an operation mode for cooling the freezer compartment of the first operation mode, the four-way valve is configured to operate based on the second outlet part being opened and the first outlet part being closed.

5. The refrigerator according to claim 2, wherein the four-way valve is configured to operate based on the first and second outlet parts being opened in an operation mode for simultaneous cooling of the first operation mode.

6. The refrigerator according to claim 1, further comprising:

a first evaporator fan that is provided at one side of the first evaporator, and that is configured to blow cooling air in the refrigerator compartment to the first evaporator side for a defrosting of the first evaporator.

7. The refrigerator according to claim 6, wherein, based on an operation mode for defrosting the first evaporator being performed, the four-way valve is configured such that the refrigerant flows to the second evaporator side, a flow to the first evaporator and the hot gas path being restricted, and the first evaporator fan is configured to operate.

8. The refrigerator according to claim 1, wherein at least one of the first and second expanders comprises a capillary tube.

9. The refrigerator according to claim 1, wherein the second evaporator further includes a fin in which a plurality of openings are formed, and wherein the first and the second pipes are configured to pass through the plurality of openings.

10. The refrigerator according to claim 9, wherein the plurality of openings include:

a first opening through which the first pipe is configured to pass; and a second opening through which the second pipe is configured to pass.

11. The refrigerator according to claim 10, wherein a diameter of the first opening is greater than the diameter of the second opening.

12. The refrigerator according to claim 10, wherein the first opening includes a plurality of first openings and the second opening includes a plurality of second openings, wherein the plurality of second openings are provided between the plurality of first openings.

* * * * *